US011852134B2

(12) United States Patent
Williams et al.

(10) Patent No.: US 11,852,134 B2
(45) Date of Patent: Dec. 26, 2023

(54) AUTOMATED MIX WATER TEST

(71) Applicant: Halliburton Energy Services, Inc., Houston, TX (US)

(72) Inventors: Derek R. Williams, Duncan, OK (US); Charles E. Neal, III, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 126 days.

(21) Appl. No.: 17/518,867

(22) Filed: Nov. 4, 2021

(65) Prior Publication Data

US 2023/0135663 A1 May 4, 2023

(51) Int. Cl.

| | |
|---|---|
| ***F04B 51/00*** | (2006.01) |
| ***B01F 35/22*** | (2022.01) |
| ***E21B 33/13*** | (2006.01) |

(52) U.S. Cl.

CPC ..... *F04B 51/00* (2013.01); *B01F 35/22* (2022.01); *B01F 2215/0436* (2013.01); *E21B 33/13* (2013.01)

(58) Field of Classification Search

None

See application file for complete search history.

(56) References Cited

U.S. PATENT DOCUMENTS

| | | | | |
|---|---|---|---|---|
| 5,624,182 | A | 4/1997 | Dearing, Sr. et al. | |
| 7,720,574 | B1 * | 5/2010 | Roys | G01F 15/063 700/282 |
| 10,253,625 | B2 | 4/2019 | Williams et al. | |
| 10,392,918 | B2 | 8/2019 | Harkless et al. | |
| 10,801,491 | B2 * | 10/2020 | Urdaneta | F04B 49/065 |
| 11,002,269 | B2 | 5/2021 | Pal et al. | |
| 2003/0072208 | A1 | 4/2003 | Rondeau et al. | |

(Continued)

FOREIGN PATENT DOCUMENTS

| | | | |
|---|---|---|---|
| CA | 2999968 | C | 4/2017 |
| CN | 110838155 | A | 2/2020 |

(Continued)

OTHER PUBLICATIONS

KR 20170030823 A, IDS record, translation (Year: 2017).*

(Continued)

*Primary Examiner* — Lina Cordero

(74) *Attorney, Agent, or Firm* — Conley Rose, P.C.; Rodney B. Carroll

(57) ABSTRACT

A method of determining a health status of a mixing system may comprise establishing a flow loop via a pump, a flow control valve, and a flow rate sensor. The method may also include performing a diagnostic test that includes positioning the flow control valve in a first position, operating the pump to communicate a fluid via the flow loop at a first speed, measuring a first periodic dataset while the fluid is communicated via the flow loop, and recording the first periodic dataset. The method may also include comparing a result of the diagnostic test to an operational indicator set, determining the health status based upon the comparison of the result of the diagnostic test and the operational indicator set, and outputting, by the unit controller, indicia of the health status of the mixing system via the input output device.

20 Claims, 8 Drawing Sheets

(56) References Cited

U.S. PATENT DOCUMENTS

| | | | | |
|---|---|---|---|---|
| 2003/0168258 | A1* | 9/2003 | Koederitz | E21B 21/08 175/48 |
| 2006/0052903 | A1 | 3/2006 | Bassett | |
| 2012/0025997 | A1 | 2/2012 | Liu et al. | |
| 2016/0194942 | A1 | 7/2016 | Wiegman et al. | |
| 2017/0002644 | A1 | 1/2017 | Chen et al. | |
| 2017/0022788 | A1* | 1/2017 | Oehring | F04B 49/20 |
| 2017/0226842 | A1 | 8/2017 | Omont et al. | |
| 2018/0363459 | A1 | 12/2018 | Williams et al. | |
| 2019/0128254 | A1* | 5/2019 | Shichi | G01L 9/125 |
| 2019/0317488 | A1 | 10/2019 | Al-Maghlouth et al. | |
| 2020/0103889 | A1 | 4/2020 | Cella et al. | |
| 2020/0191130 | A1 | 6/2020 | Van Der Spek et al. | |
| 2020/0347713 | A1* | 11/2020 | Omont | E21B 33/138 |
| 2020/0355067 | A1 | 11/2020 | Williams et al. | |
| 2020/0362664 | A1 | 11/2020 | Urdaneta et al. | |
| 2021/0306804 | A1 | 9/2021 | Adler et al. | |

FOREIGN PATENT DOCUMENTS

| | | | |
|---|---|---|---|
| CN | 210402440 | U | 4/2020 |
| CN | 212272574 | U | 1/2021 |
| EP | 1485574 | B1 | 11/2007 |
| JP | 4766814 | B2 | 9/2011 |
| KR | 101154275 | B1 * | 6/2012 |
| KR | 20170030823 | A | 3/2017 |
| KR | 20180044086 | A | 5/2018 |
| KR | 20200075229 | A | 6/2020 |
| WO | 2016160459 | A2 | 10/2016 |
| WO | 2021050943 | A1 | 3/2021 |

OTHER PUBLICATIONS

KR 101154275 B1, translation (Year: 2012).*

Filing Receipt, Specification and Drawings for U.S. Appl. No. 17/529,061, entitled "Predictive Pump Maintenance Based Upon Utilization and Operating Conditions," filed Dec. 2, 2021, 78 pages.

Electronic Acknowledgement Receipt, Specification and Drawings for International Application No. PCT/US2021/60309, entitled "Predictive Pump Maintenance Based Upon Utilization and Operating Conditions," filed Nov. 22, 2021, 57 pages.

Electronic Acknowledgement Receipt, Specification and Drawings for International Patent Application No. PCT/US2021/58718, entitled "Automated Mix Water Test," filed Nov. 10, 2021, 68 pages.

Filing Receipt, Specification and Drawings for U.S. Appl. No. 17/486,400, entitled "Cementing Unit Power on Self Test," filed Oct. 8, 2021, 64 pages.

Filing Receipt, Specification and Drawings for U.S. Appl. No. 17/518,869, entitled "Automated Configuration of Pumping Equipment," filed Nov. 18, 2021, 84 pages.

Electronic Acknowledgement Receipt, Specification and Drawings for International Patent Application No. PCT/US2021/58720, entitled "Automated Configuration of Pumping Equipment," filed Nov. 10, 2021, 84 pages.

Foreign Communication from Related Application—International Search Report and Written Opinion of the International Searching Authority, International Application No. PCT/US2021/058720, dated Aug. 1, 2022, 12 pages.

Foreign Communication from Related Application—International Search Report and Written Opinion of the International Searching Authority, International Application No. PCT/US2021/060309, dated Aug. 9, 2022, 12 pages.

Foreign Communication from Related Application—International Search Report and Written Opinion of the International Searching Authority, International Application No. PCT/US2021/058718, dated Jul. 26, 2022, 12 pages.

English Translation of JP4766814B2, 2011, 42 Pages.

Office Action dated Jun. 12, 2023 (39 pages), U.S. Appl. No. 17/486,400, filed Sep. 27, 2021.

Office Action dated Oct. 2, 2023 (39 pages), U.S. Appl. No. 17/529,061, filed Nov. 17, 2021.

* cited by examiner

AUTOMATED MIX WATER TEST

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In oil and gas wells, a primary purpose of a barrier composition such as cement or a sealant is to isolate the formation fluids between zones, also referred to as zonal isolation and zonal isolation barriers. Cement is also used to support the metal casing lining the well, and the cement provides a barrier to prevent the fluids from damaging the casing and to prevent fluid migration along the casing.

Typically, an oil well is drilled to a desired depth with a drill bit and mud fluid system. A metal pipe (e.g., casing, liner, etc.) is lowered into the drilled well to prevent collapse of the drilled formation. Cement is placed between the casing and formation with a primary cementing operation. One or more downhole tools may be connected to the casing to assist with placement of the cement.

In a primary cementing operation, a cement blend tailored for the environmental conditions of the wellbore is pumped into the wellbore. This pumping operation may utilize pumping equipment, which may include a plurality of components controlled by a controller such as valves and pumps. The plurality of components may require routine maintenance and, in some cases, repair of one or more components. Personnel may perform a diagnostic test of one or more of these components before a job, although the data generated about the operation of these components is not necessarily conclusive as to the capacity of those components to complete the intended job, nor is the data necessarily indicative of the operational condition of the equipment. Improved methods of determining the operational condition of the pumping equipment are needed.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 4 is an illustration of a pump performance graph according to an embodiment of the disclosure.

DETAILED DESCRIPTION

Figure 1:
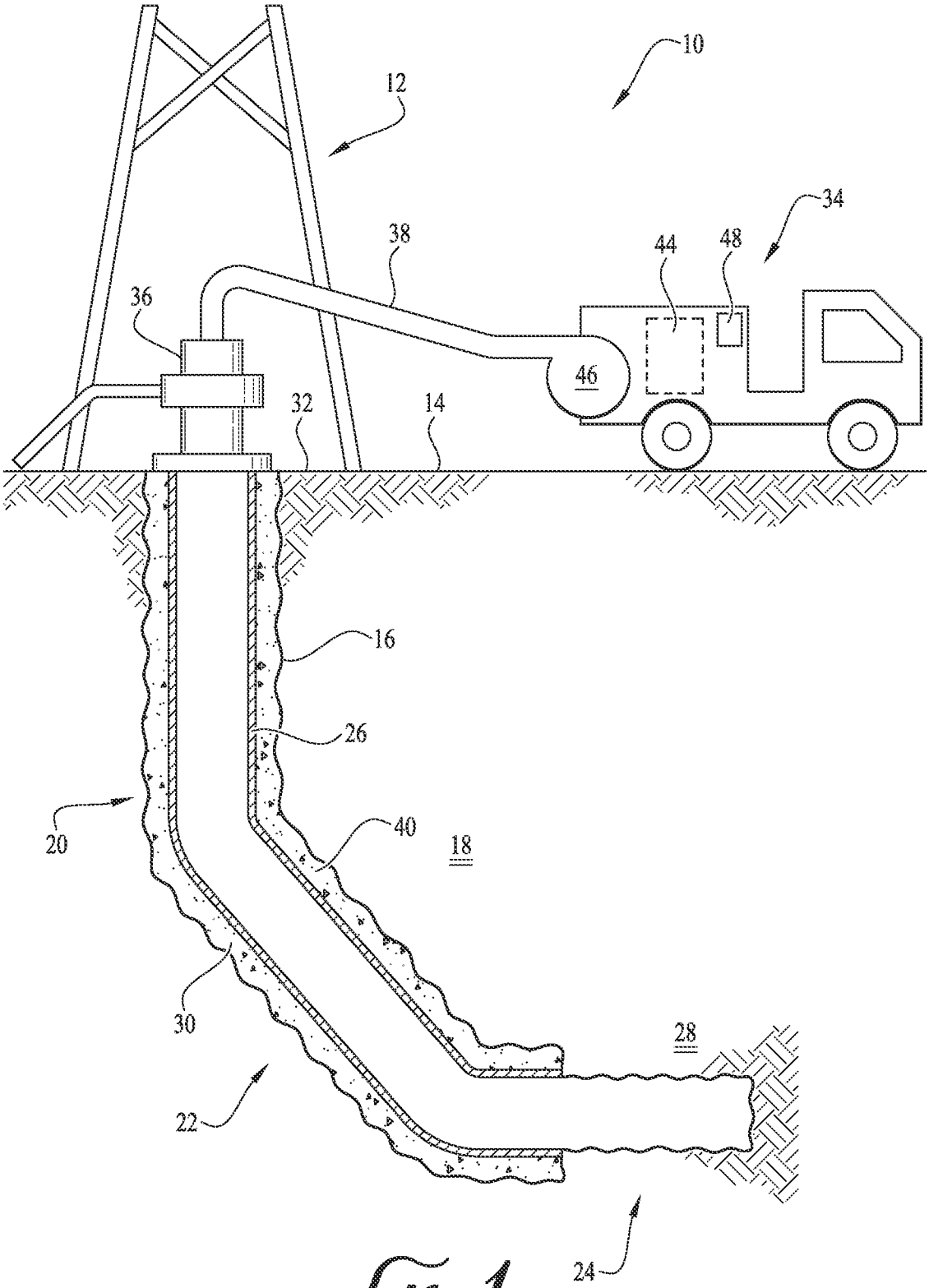
FIG. 1 is an illustration of an operating environment at a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Oil well construction can follow a series of construction stages including drilling, cementing, and completion or stimulation. Each stage can be carried out using specialized equipment and materials to complete each stage.

Examples of the equipment that may be used at these stages include various configurations, types, and/or sizes of pumping equipment. For example, during the drilling stage, an oil well can be drilled with a drill bit, a mud system, and a mud pump. As the drill bit penetrates the earth strata, a drilling mud is pumped down a drill string to bring cuttings back to the surface, an example of which includes a reciprocating (e.g., plunger-type) pump. The mud pumping equipment may include a mixing system for blending dry mud blend with a liquid, e.g., water, to produce a mud slurry.

Also, for example, during the cementing stage, a cement pump may be used to introduce a cementitious slurry, e.g., a cement composition, into the annulus formed between the casing and the wellbore. The cement typically used for cementing oil wells can be a Portland cement comprised of a hydraulic cement with a source of free lime and alkali ions, a source of calcium carbonate, a source of calcium sulfate and an organic component. The mixing system can blend the dry cement with water to produce the cement slurry.

In another example, during the completion and/or stimulation stage, a blender and high pressure pump may be used to fracture a formation with a proppant slurry. The blender, also referred to as a blender unit, may include a mixing system for blending proppant, e.g., sand, and water with various additives, e.g., friction reducers, to produce the proppant slurry. The high pressure pumps, also referred to as fracturing units, may deliver the proppant slurry into the wellbore with sufficient pressure to fracture the formation and deposit the proppant into the fractures.

The pumping equipment used at various well construction stages may include or be communicatively coupled to a unit controller. The unit controller may comprise a computer system with one or more processors, memory, input devices, and output devices. The unit controller may be programmable with one or more pumping procedures for the mixing and placement of wellbore treatments. The unit controller can be communicatively connected to various components of the pumping equipment including the mixing system and main pump. For example, the unit controller may be communicatively coupled to a mixing drum, a water pump, a plurality of valves, an additive system, a main pump, and a data acquisition system. The unit controller can establish control over the various components of the pumping equipment, e.g., the mixing system, with the data acquisition system providing feedback of the pumping operation. In some cases, the respective unit controllers associated with two or more pumping equipment assemblies may be communicatively connected so that the pumping equipment assemblies cooperatively work together. For example, the blender and one or more high pressure pumps may cooperatively deliver proppant slurry to the wellbore.

The delivery of the wellbore treatment, e.g., a cement slurry, from the pumping equipment at a desired flowrate can depend upon the health of the mixing system. The health of the mixing system may decline based on the accumulated volume of treatments mixed, the amount of time in operation, and/or the number of jobs performed. For example, the various components of the mixing system may encounter wear and general degradation of operating ability during normal operation from sequential jobs. Service personnel can perform diagnostic tests on the various components of the mixing system before or after a job, however, in some cases the diagnostic tests can be inconclusive and/or service personnel may not recognize data indicative of present or forthcoming problems. Additionally or alternatively, the service personnel may fail to record or submit the diagnostic test results for evaluation. As such, an improved method of determining the health status of the mixing system is needed.

In an embodiment, a system for automatically determining the health status of the mixing system can include an application executed via unit controller associated with a mixing system. The application can execute a diagnostic method, for example, a diagnostic test, on the mixing system by causing components of the mixing system to perform a predetermined routine while automatically logging the results. In an embodiment, the predetermined routine may comprise a flowrate test performed on the mixing system. For example, the application may cause the mixing system to perform steps that include setting a valve position, operating a pump such that a fluid is communicated through one or more components of the mixing system at one or more predetermined flowrates, and recording data from sensors during communication of the fluid. The data from the sensors can be logged into a data storage location on the unit controller and, optionally, displayed on Human Machine Interface (HMI), e.g., a display. The data can comprise pump speed value, valve position value, flowrate data, pressure data, or combinations thereof. The data may be subjected to processing to yield results indicative of the health status of the mixing system. For example, the results may indicate that the mixing system is operating nominally, that the mixing system, or a component thereof, needs maintenance, that the flowrate of a supply pump is below an operating threshold, that the mixing system cannot obtain the needed flowrates and should be taken out of service, or combinations thereof. The results may be displayed as a curve, a table, or a simple pass or fail, e.g., pass/fail status, an error or warning message, or combinations thereof.

Additionally or alternatively, in an embodiment the unit controller can cause the data and/or results to be wirelessly communicated between the system and a remote location, for example, a remote service center. For example, in an embodiment, the unit controller may comprise or be communicatively coupled to a wireless communication assembly capable of wireless communication with the remote service center, such as through a mobile network. In some embodiments, the data can be transmitted to the remote service center for processing to yield the results indicative of the health of the mixing system. Additionally or alternatively, in some embodiments the results of the flowrate test can be transmitted to the remote location, for example, a data storage location and/or the remote service center, for recordation. The unit controller may automatically report the health status of the mixing system at the end of the test.

FIG. 1 illustrates a well site environment 10, according to one or more aspects of the presently-disclosed subject matter. The well site environment 10 comprises a drilling or servicing rig 12 that extends over and around a wellbore 16 that penetrates a subterranean formation 18 for the purpose of recovering hydrocarbons. The wellbore 16 can be drilled into the subterranean formation 18 using any suitable drilling technique. While shown as extending vertically from the surface 14 in FIG. 1, the wellbore 16 can also be deviated, horizontal, and/or curved over at least some portions of the wellbore 16. For example, the wellbore 16, or a lateral wellbore portion of the wellbore 16, can have a vertical portion 20, a deviated portion 22, and a horizontal portion 24. Portions or all of the wellbore 16 can be cased, open hole, or combination thereof. For example, a first portion extending from the surface can contain a string of casing 26 and a second portion can be a wellbore drilled into a subterranean formation 28. A primary casing string 26 can be placed in the wellbore 16 and secured at least in part by cement 30.

The servicing rig 12 can be one of a drilling rig, a completion rig, a workover rig, or other structure and supports operations in the wellbore 16. The servicing rig 12 can also comprise a derrick, or other lifting means, with a rig floor 32 through which the wellbore 16 extends downward from the servicing rig 12. In some cases, such as in an off-shore location, the servicing rig 12 can be supported by piers extending downwards to a seabed. Alternatively, the servicing rig 12 can be supported by columns sitting on hulls and/or pontoons that are ballasted below the water surface, which can be referred to as a semi-submersible platform or floating rig. In an off-shore location, a casing can extend from the servicing rig 12 to exclude sea water and contain drilling fluid returns.

In an embodiment, the wellbore 16 can be completed with a cementing process by way of which a cement 30 is disposed in an annular space 40 between the casing string 26 and the wellbore 16. A pump unit 34, also called cement pumping equipment 34, can be fluidically connected to a wellhead 36 by a supply line 38. The wellhead 36 can be any type of pressure containment equipment connected to the top of the casing string 26, such as a surface tree, production tree, subsea tree, lubricator connector, blowout preventer, or combination thereof. The wellhead 36 can anchor the casing string 26 at surface 14. The wellhead 36 can include one or more valves to direct the fluid flow from the wellbore and one or more sensors that gather pressure, temperature, and/or flowrate data. In operation, the pump unit 34 can pump a volume of cementitious slurry, which may be specifically tailored to the wellbore, though the supply line 38, through the wellhead 36, down the casing string 26, and into the annular space 40.

The cement 30 can be Portland cement or a blend of Portland cement with various additives to tailor the cement for the wellbore environment. For example, retarders or accelerators can be added to the cementitious slurry to slow down or speed up the curing process. In some embodiments, the cement 30 can include a polymer designed for high temperatures. In some embodiments, the cementitious slurry can include additives such as fly ash to change the density, e.g., decrease the density, of the cementitious slurry.

The pump unit 34, also referred to as a wellbore pump unit, may include mixing equipment 44, pumping equipment 46, and a unit controller 48. The mixing equipment 44 can be in the form of a jet mixer, recirculating mixer, a batch mixer, a single tub mixer, or a dual tub mixer with a mixing device and a liquid delivery system. The mixing equipment 44 can combine a dry ingredient, e.g., cement, with a liquid, e.g., water, for pumping via the pumping equipment 46 into the wellbore 16. The liquid delivery system comprises a supply pump, a flow control valve, and sensors. The pumping equipment 46 can be a centrifugal pump, piston pump, or a plunger pump. The unit controller 48 may establish control of the operation of the mixing equipment 44 and the pumping equipment 46. The unit controller 48 can operate the mixing equipment 44 and the pumping equipment 46 via one or more commands received from the service personnel as will be described further herein. Although the pump unit 34 is illustrated as a truck, it is understood that the pump unit 34 may be skid mounted or trailer mounted. Although the pump unit 34 is illustrated as a single unit, it is understood that there may be 2, 3, 4, or any number of pump units 34 fluidically coupled to the wellhead 36, for example, via a fluid manifold.

Although the embodiment of FIG. 1 describes the well site environment 10 in the context of a cementing operation, in an additional or alternative embodiment, for example, in the context of a drilling or completion operation, a pump unit similarly-situated to the pump unit 34 of FIG. 1 can be a mud pump fluidically connected to the wellbore 16 by the supply line 38 to pump drilling mud slurry or a water based fluid such as a completion fluid, e.g., a completion brine, into the wellbore 16. Mixing equipment 44 may similarly be employed to blend or mix a dry mud blend with a fluid such as water or oil-based fluid. The pumping equipment 46 may include a piston pump or other suitable type or configuration. The drilling mud slurry or the completion brine may be referred to as a wellbore treatment.

In an alternate embodiment, for example, in the context of a completion operation, a pump unit similarly situated to the pump unit 34 of FIG. 1 can be a blender fluidically connected to one or more high pressure pumping units, also called "frac" pumps, that are fluidically connected to the wellbore 16 by the supply line 38 to pump a wellbore treatment, e.g., frac slurry, into the wellbore 16. Mixing equipment like the mixing equipment 44 of FIG. 1 may similarly be employed to blend or mix a proppant, e.g., sand, with a water mixture that includes one or more additives, e.g., a friction reducer or a gel, into the frac slurry. The pumping equipment 46 may be a centrifugal pump or a plunger pump. Although one pump unit 34 is illustrated in FIG. 1, it is understood that two or more pump units may be coupled to the wellbore 16 and communicatively coupled by the unit controller 48 to cooperatively pump a wellbore treatment into the wellbore 16. For example, a blender may be fluidically coupled to wellhead 36 via a frac pump. The blender and the frac pump may be communicatively coupled by the unit controller 48.

Figure 2:
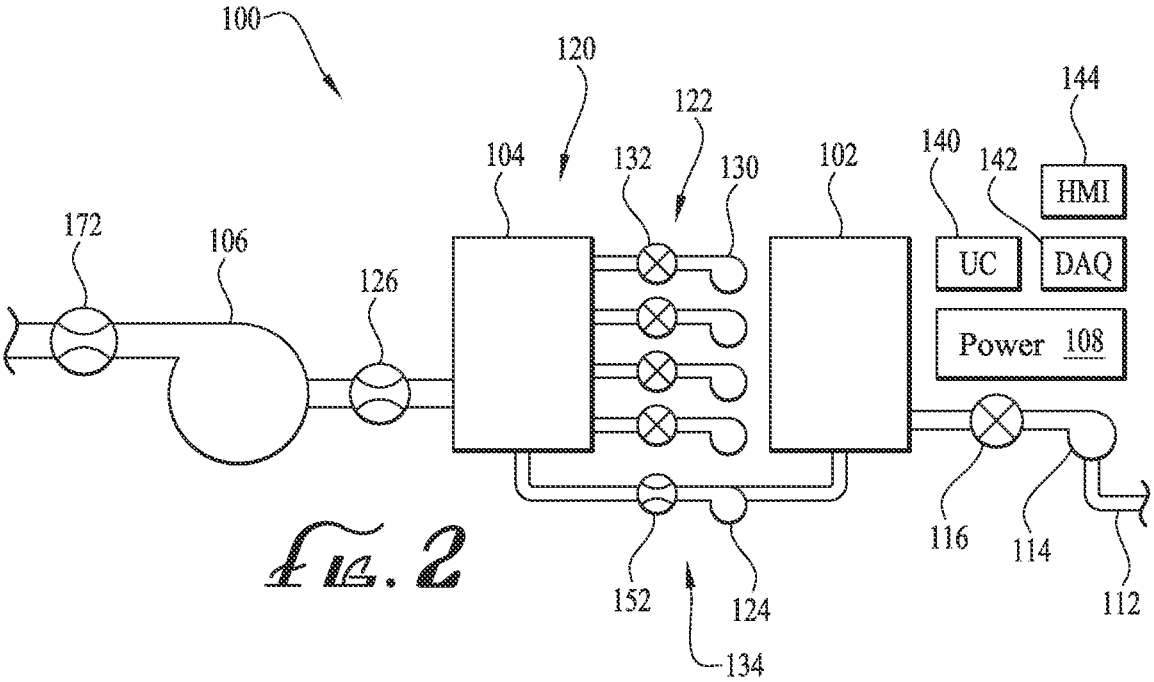
FIG. 2 is an illustration of a pump unit assembly according to an embodiment of the disclosure.

Referring to FIG. 2, a particular embodiment of the pump unit 34 is illustrated in further detail as pump unit 100. In the embodiment of FIG. 2, the pump unit 100 comprises a supply tank 102, a mixing system 120, a main pump 106, and at least one power supply 108. The main pump 106 can be a centrifugal pump. The power supply 108 can include one or more electric-, gas-, or diesel-powered motors which are coupled to the supply tank 102, the mixing system 120, the main pump 106, and the various components such as feed pumps and valves. The power supply 108 may supply power to actuate the main pump 106. For example, the power supply 108 can be directly coupled by a drive shaft or indirectly coupled, such as via an electrical power supply, to the main pump 106. The mixing system 120 can blend a fluid composition of water, dry ingredients, e.g., cement, mud, or sand, and other additives for delivery to the wellbore 16 via the main pump 106.

The pump unit 100 may comprise a unit controller 140, a data acquisition system (DAQ) card 142, and a display 144. The unit controller 140 may comprise a computer system comprising one or more processors, memory, input devices, and/or output devices. The unit controller 140 may have one or more applications executing in memory and configured to carry out one or more of the methods or protocols disclosed herein, or a portion thereof. The unit controller 140 may be communicatively connected to the pumping equipment and mixing equipment of the pump unit 34. The DAQ card 142 may convert one or more analog and/or digital signals into signal data. In various embodiments, the DAQ card 142 may be a standalone system with a microprocessor, memory, and one or more applications executing in memory, or may be combined or incorporated with the unit controller 140 into a unitary assembly. For example, the DAQ card 142 may be combined with one of the input output devices of the unit controller 140 when combined into a unitary assembly. The display 144, e.g., interactive display, may be a suitable configuration of Human Machine Interface (HMI) that provides an input device and an output device for the unit controller 140. Additional or alternative displays may also be used. The display 144 may include a selectable input screen that includes icons and selectable key board or key pad inputs for the unit controller 140. The display 144 may display data and information about the status and operation of the pump unit 100 to a user, including data from the DAQ card 142.

The supply tank 102 can store a volume of water or other liquid and provide the water or liquid for use in the mixing system 120. The supply tank 102 can be connected to a water supply unit by a supply line 112, a supply pump 114, and a supply valve 116. The supply pump 114 can comprise a centrifugal pump, a piston pump, or a plunger pump. The supply valve 116 can comprise a flow control valve, e.g., a globe valve, a pinch valve, or a needle valve, that can be open, closed, or regulate the fluid flow within. The unit controller 140 may provide power, e.g., voltage and current, and/or a control signal to the supply valve 116 and the supply pump 114. The supply tank 102 may have one or more sensors, e.g., a tub level sensor, communicatively connected to the unit controller 140 via the DAQ card 142.

The mixing system 120 can include the mixing drum 104, one or more additive systems 122, and a liquid delivery system 134. The liquid delivery system can fluidically connect the supply tank 102 to the mixing drum 104. The one or more additive systems 122 may fluidically connect a volume of liquid additives, such as accelerators, retarders, extenders, fluid loss, and viscosity modifiers, to the mix drum 104. The additive systems 122 can comprise an additive pump 130, an additive valve 132, and flow meter. The additive pump 130 can be a diaphragm pump, a piston pump, or a centrifugal pump. The additive valve 132 can be an on-off valve such as a ball valve or plug valve. Each additive pump 130 can be communicatively coupled to a corresponding flow meter and to the unit controller 140 via the DAQ card 142. The unit controller 140 can dispense a predetermined volume of additive by controlling the additive pump 130 and additive valve 132 with feedback from the flow meter. The liquid delivery system 134 can supply a predetermined flowrate of liquid, e.g., water, to the mix drum 104. The unit controller 140 may change the volumetric rate of the liquid, e.g., water, with the supply pump 124 and the valve position of the flow control valve 152 in response to the data from one or more sensors, e.g., flow meter. The mixing system 120 can include a mixing valve 126 located downstream from the mixing drum 104. The mixing valve 126 can be a flow control valve or an isolation valve, e.g., a ball valve or plug valve.

The liquid delivery system 134 comprises a supply pump 124 and a flow control valve 152. The flow control valve 152 may be a globe valve, a pinch valve, a needle valve, a plug valve, or a slide valve. The supply pump 124 may be a centrifugal pump, a plunger pump, a screw pump, a piston pump, or combinations thereof. The unit controller 140 can direct the liquid delivery system 134 to pump water at a desired flowrate from the supply tank 102 to the mix drum 104 with various sensors providing feedback. In an embodiment, the liquid delivery system 134 can pump water from a supply line 112 connected to a water supply unit.

The main pump 106 may be configured according to the operation in which it will be employed. For example, the main pump 106 may be a centrifugal pump, a piston pump, or a plunger pump. For example, in the context of a cementing operation, the main pump 106 can be a centrifugal pump. The slurry mixed within the mixing drum 104 can be transferred to the main pump 106 via the mixing valve 126. The main pump 106 may have a main valve 172 coupled to the outlet of the main pump 106. The main valve 172 may be a stand-alone valve or may be a portion of a discharge manifold. A discharge manifold may have one or more flow valves and one or more isolation valves. The main valve 172 can be a flow control valve or an isolation valve such as a plug valve or ball valve. The unit controller 140 may be communicatively coupled to the main pump 106 and the main valve 172. The unit controller 140 may control the operation of the main pump 106 to change the pump rate of the main pump 106 and the valve position of the main valve 172 in response to the data from one or more sensors, e.g., a flow meter.

Although the pump unit 100 of FIG. 2 is described as a cement pumping unit, it is understood that the pump unit 100 may be a mud pump, a blender, a frac pump, or a water supply. Each type or configuration of pump unit, e.g., a mud pump, a cement pump unit, a blender, a frac pump, or a water supply, may include a main pump, e.g., main pump 106, a flow control valve, e.g., flow control valve 152, and a unit controller, e.g., unit controller 140. The unit controller, e.g., unit controller 140, may receive data via a DAQ card 142. The unit controller 140 of the pump unit, e.g., pump unit 100, may be communicatively connected to one or more pump units, e.g., pump unit 100, at the wellsite. The pump unit, e.g., pump unit 100, may work in concert with at least one more pump unit, e.g., pump unit 100. In a scenario, the pump unit 100 may be controlled, via the unit controller 140, by a control system at the wellsite. The pump unit 100 may be communicatively connected to a control system at the wellsite.

In some embodiments, a wellbore servicing method may include providing a wellbore treatment, via a pump unit, following a prescribed pumping procedure for the placement of the wellbore treatment at a target location within the wellbore. The wellbore treatment placed in the performance of the pumping procedure can include a treatment blend, e.g., cement blend, a liquid blend, e.g., water with additives, or combinations thereof and may be placed via one or more downhole tools.

In an embodiment, the wellbore servicing method may comprise transporting the pump unit, e.g., 34 of FIG. 1, to the wellsite environment 10. The pump unit 34 may be positioned at the wellsite and fluidly connected the wellbore 16, for example, via a supply line 38 coupled to the wellhead 36.

The liquid and/or treatment blend may be prepared within the pump unit, e.g., 34 of FIG. 1, as a wellbore treatment, e.g., a cementitious slurry. The pump unit, e.g., 34 of FIG. 1, can mix the treatment blend and the liquid blend within the mixing equipment, e.g., 44 of FIG. 1, to form a treatment slurry and pump the treatment slurry into the wellbore 16 with the pumping equipment 46 via the supply line 38. The pumping unit 34 can deliver the treatment slurry into the wellbore 16 at a desired flowrate per the pumping procedure. Turning back to FIG. 2, the flowrate of the blended slurry from the pump unit 100 to the wellbore 16 can be controlled by the unit controller 140. The liquid delivery system 134 can transfer a liquid, e.g., water, from the supply tank 102 to the mixing drum 104 at a predetermined flowrate per the pumping procedure to create the blended slurry within the mixing system 120 for delivery to the wellbore 16 via the main pump 106. The operational capacity of the liquid delivery system 134 to deliver fluid at a desired or predetermined flowrate can depend on the health of the mixing system 120.

In an embodiment, a method of providing a wellbore treatment to a wellbore may include one or more steps effective to determine the health of the mixing system 120. As used herein, the term "health," when used with reference to the mixing system 120, may refer to the ability of the liquid delivery system 134 to transfer a liquid to the mixing drum 104 for blending of the wellbore treatment in accordance with a specified operational capacity. The operational capacity of the liquid delivery system 134 can be described as the fluid output, e.g., pressure and flowrate, from the supply tank 102, to the mix drum 104 via the supply pump 124 and flow control valve 152. In an embodiment, the determination of the health of the mixing system 120 can comprise a determination that the mixing equipment 120 attains an operational capacity in accordance with the needs of a current or anticipated pumping operation and/or a determination that the mixing equipment 120 attains at least a minimum operational capacity. In an embodiment, the minimum operational capacity of the liquid delivery system 134 may be the minimum rated capacity, e.g., pressure and flowrate, of the supply pump 124, when operating optimally, at a given pump speed measured in revolutions per minute (RPM). As will be appreciated by those of skill in the art upon viewing this disclosure, the supply pump 124, when new or newly-refurbished, may attain optimal performance, such as the rated pump capacity. However, the performance, e.g., output, of the supply pump 124 may decrease due to damage from wear, erosion, material degradation, and/or failure of one or more pump components such as seals, bearings, valves, or impellers.

As will be appreciated by those of skill in the art upon viewing this disclosure, a current or anticipated pumping operation may require that the mixing equipment be able to provide certain operational performance values, e.g., a combined pressure and flowrate, less than the minimum operational capacity of the mixing equipment. However, a change in wellbore conditions may require the mixing equipment 120 to perform at a higher operational performance value that may include the minimum operational capacity. As such, it is important to understand the operational capacity of the liquid delivery system 134 prior to beginning a wellbore servicing operation at a wellsite.

In an embodiment, a diagnostic test to determine the health status of the mixing system 120 may be automatically performed prior to the initiation of a wellbore servicing operation, at the completion of a wellbore servicing operation, or both. For example, the diagnostic test may be included in a startup procedure for the pumping unit 100, a shutdown procedure for the pumping equipment, or both. When the diagnostic test is to be performed, the unit controller 140 may automatically initiate the diagnostic test or may prompt a user, e.g., service personnel, to initiate the diagnostic test. In an embodiment, the pumping unit may be prohibited from completing a startup or shutdown procedure where the diagnostic test is not completed, for example, such that the pumping unit cannot be used in the performance of a wellbore servicing operation until the diagnostic test is completed.

In an embodiment, the results of the diagnostic test can be outputted, for example, as an alert provided to the service personnel, for example, a pass/fail indicia, a text message, or combination. For example, in an embodiment, the service personnel may be notified of a "fail" status, which may be the result of the diagnostic test. Additionally or alternatively, the fail status may be the result of a missing system performance file including the results of the diagnostic test, a corrupted system performance file, or a system performance file that cannot be accessed. In various embodiments, the alert provided to the service personnel may be generated by the unit controller 140, a remote computer, e.g., executing on a network location, or a combination thereof as will be disclosed further hereinafter. Additionally or alternatively, the results of the diagnostic test may form the basis for an action. For example, where a pumping unit 100 has been assigned a fail status, the unit controller 140 may prohibit operation of the pumping unit 100 until the diagnostic test has been performed and the pumping unit is assigned a pass status, until the pumping unit is serviced, or the like.

In an embodiment, a method for determining a health status of the mixing system 120 may generally include the steps of preparing the mixing system 120 for a diagnostic test, running the diagnostic test and collecting a plurality of periodic datasets, assessing the plurality of periodic datasets, and determining health of the mixing system 120 based upon the results of assessing the dataset.

Figure 3:
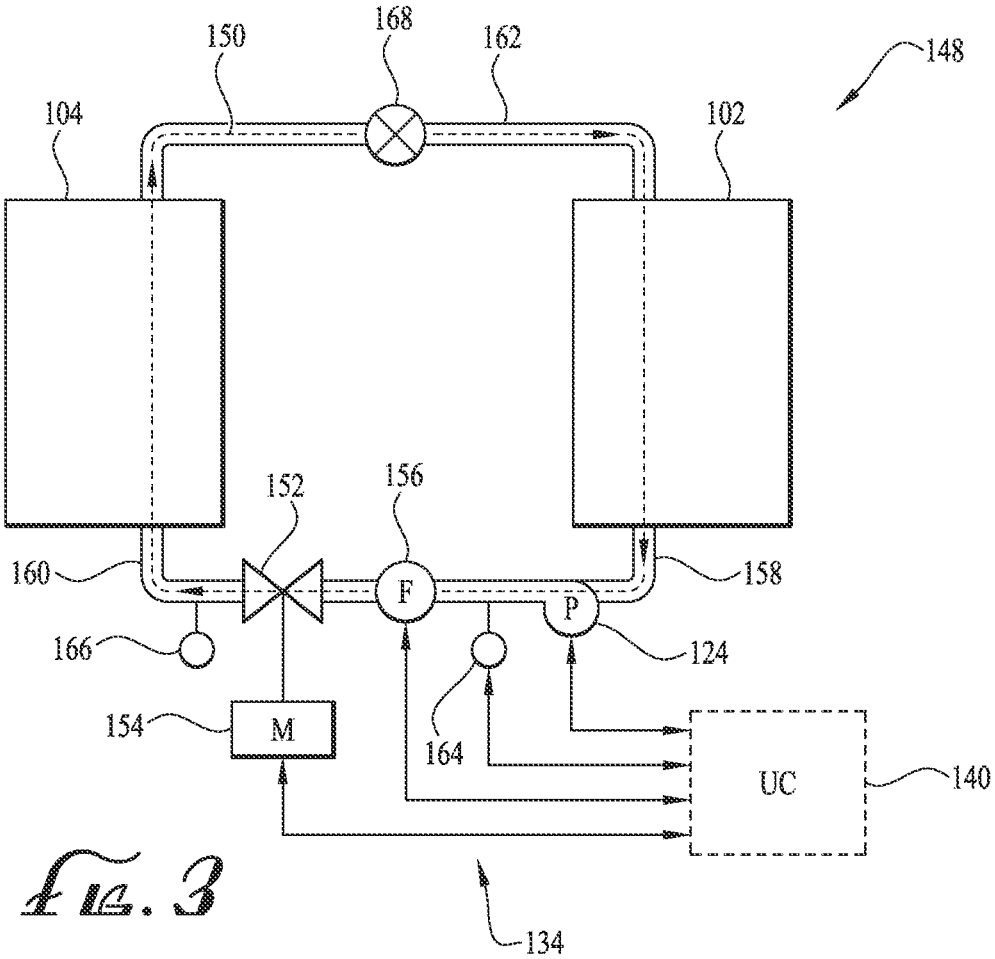
FIG. 3 is an illustration of an automated flow loop environment subject to diagnostic testing according to an embodiment of the disclosure.
Figure 1:
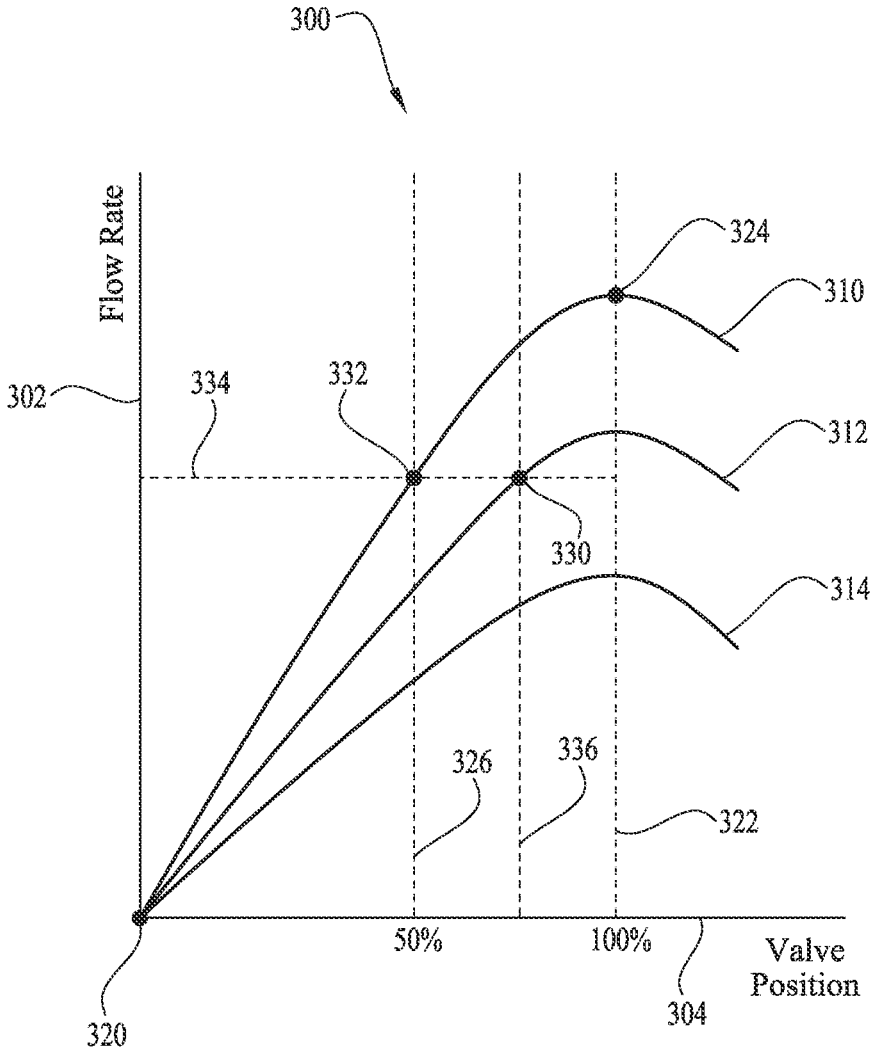

In an embodiment, the mixing system 120 may be prepared for the diagnostic test by configuring the mixing system 120 as a flow loop through at least a portion of the mixing system 120. For example, turning now to FIG. 3, an example of a flow loop 150 is described. For example, in some embodiments, the unit controller 140 may control the pump unit 100 components, e.g., one or more components of the pump unit 100, so as to establish the flow loop 150 by causing one or more valves to be opened or closed. For example, as shown in FIG. 3, the unit controller 140 can cause the mixing valve 126, the supply valve 116, and the plurality of additive valves 132 of the additive systems 122 to be closed, and by causing an isolation valve 168 on a return line 162 from the mixing drum 104 and the supply tank 102 and a flow control valve 152 on the supply line 158 from the supply tank 102 to the mixing drum 104 to be opened. The return line 162 and the supply line 158 may include a portion of a larger manifold system of the pump unit 100. It is understood that in FIG. 3 the location of the supply line 158 and location of the return line 162 are illustrated for clarity and may not represent the actual, physical location of such components. For example, the return line 162 may be located adjacent of the supply line 158 or vice versa. Also, although one valve is shown in the return line 162 and the supply line 158, it is understood that the return line 162 and the supply line 158 can include 1, 2, 3, or any number of valves. The flow loop 150 includes some of the same components previously described in FIG. 2 and are labeled the same. For example, the flow loop 150 comprises the supply tank 102, the supply line 158, the supply pump 124, the flow control valve 152, the mix drum 104, the return line 162, and the isolation valve 168. The supply line 158 can include a flowrate sensor 156, a first pressure sensor 164, and a second pressure sensor 166 communicatively connected to the unit controller 140. The valve actuator 154 can be mechanically connected to the flow control valve 152 and communicatively connected to the unit controller 140. The flow control valve 152, the valve actuator 154, or combinations thereof may include one or more valve position sensors communicatively connected to the unit controller 140. The flowrate sensor 156 may comprise a turbine type or Coriolis type flow meter.

Also, in some embodiments, the mixing system 120 may be prepared for the diagnostic test by filling or otherwise providing fluid to the flow loop 150. For example, the unit controller 140 may control pump unit 100 components to fill the flow loop 150 by placing water in the supply tank 102 and/or the mixing drum 104 via the supply line 112. For example, the unit controller 140 may open the supply valve 116 and operate the supply pump 114 to fill the supply tank 102 and the mixing drum 104 until the tub level sensor in one or both locations indicates the supply tank 102 or mixing drum 104 is sufficiently filled with water. For example, the unit controller 140 may fill the supply tank 102 and mixing drum 104 until at least one tub level sensors indicates that one or both tanks are 40%, 45%, 50%, 55%, 60%, or any portion of water between 15% and 100% of the filled capacity of the tubs. The unit controller 140 may stop the supply pump 114 and close the supply valve 116 such that the flow loop 150 configuration illustrated in FIG. 3 is established or reestablished.

In some embodiments, running the diagnostic test may include operating the mixing system 120 to circulate a fluid, e.g., water, through the flow loop 150 at a plurality of flowrates and/or pressures to produce the plurality of periodic datasets, which generally includes data indicative of the performance of the mixing system 120 or components thereof. In various embodiments, any suitable protocol suitable to generate the plurality of periodic datasets may be employed, although an example of a protocol is disclosed herein.

For example, the unit controller 140 may control pump unit 100 components so as to determine the maximum flowrate of the flow loop 150. The unit controller 140 may position the flow control valve 152 to a first position, for example, a fully open position, e.g., 100% open, and operate the supply pump 124 at a first flow capacity of 100% flow capacity, e.g., the rated pump capacity at the rated pump speed of the supply pump 124. The water may travel through the flow loop 150 in a continuous path from the supply tank 102, into the supply line 158, through the supply pump 124, the flowrate sensor 156, the flow control valve 152, the mixing drum 104, into the return line 162, through the isolation valve 168, and back into the supply tank 102. The supply line 158 and the return line 162 may be disposed at approximately the same height to minimize the pressure loss and/or pressure differentials due to the path of the flow loop 150. As the fluid is communicated via the flow loop 150, the unit controller 140 may monitor flowrate data from the flowrate sensor 156 for a predetermined time period, e.g., 60 seconds, or until the data from the flowrate sensor is steady-state. The unit controller 140 may record and save a periodic dataset comprising the pump speed (RPM), and a set of data for a predetermined period of time for the flowrate sensor, valve position sensor, at least one pressure sensor, at least one tub level sensor, or combination thereof for a predetermined period of time.

Additionally, the unit controller 140 may also control pump unit 100 components so as to determine a plurality of data points for the supply pump 124 operating at 100% of the rated pump speed, e.g., 100% flow capacity, with the valve position set to a plurality of positions. For example, the unit controller 140 may change the valve position and generate a second periodic dataset. For example, the unit controller 140 may change the valve position of the flow control valve 152 to second position, e.g., 75% open, while maintaining the operation of the supply pump 124 at 100% pump speed. The unit controller 140 may again record and save the second periodic dataset. The unit controller 140 may also change the valve position to a third position, a fourth position, or a plurality of predetermined positions. For example, the valve positions may include 100% open, 75% open, 50% open, 25% open, and 0% open. Although five (5) positions are listed in this example, it is understood that the unit controller 140 could control the pump unit components to likewise utilize 1, 2, 3, 4, 5, 6, 7, 8, 9, 10, or any number of valve positions. Likewise, although particular valve positions are given as an example, the unit controller 140 could specify 100% open, 90%, 80%, 70%, 60%, 50%, 40%, 30%, 20%, 10%, 0% open, or any valve position value within the range of 0% to 100%. The unit controller 140 may also record and save a periodic dataset for each valve position, for example, to a system performance file in memory.

Additionally, the unit controller 140 may change the operation of the supply pump 124 to a second pump speed, such as 50% of the rated pump speed, that corresponds to a second flow capacity, e.g. 50% flow capacity. The unit controller 140 can record and save a periodic dataset for the first valve position at the second flow capacity, change to the valve position to a second valve position, record and save a periodic dataset for the second valve position for the second flow capacity, and repeat for a plurality of valve positions for the second flow capacity.

The unit controller 140 may operate the supply pump 124 at a plurality of pump speeds that correspond to a plurality of flow capacities. For example, the unit controller 140 may operate the pump at 25%, 50%, 75%, and/or 100% of a rated pump speed, which may correspond to 25%, 50%, 75%, and/or 100% flow capacity. Although 4 pump capacity values are listed, it is understood that the unit controller 140 may operate the pump at 10%, 20%, 30%, 40%, 50%, 60%, 70%, 80%, 90%, 100%, or any capacity value within the range of 10% to 100%. The unit controller 140 may determine a periodic dataset for each of a plurality of pump flow capacities and at a plurality of valve positions at each pump flow capacity value. For example, the unit controller 140 may determine 15 periodic datasets for valve positions 100% open, 75% open, 50% open, 25% open, and 0% open of the flow control valve 152 and for the 50%, 75%, and 100% flow capacity of the supply pump 124. The plurality of periodic datasets can be written to the system performance file in a location in memory. The plurality of periodic datasets may be stored as a text string, a database, or combination thereof.

In some embodiments, the system performance file may include identifying indicia, for example, a unique serial number, capable of uniquely identifying the unit controller 140, the pump unit 100, and/or one or more components of the pump unit 100.

In some embodiments, assessing the plurality of periodic datasets may comprise subjecting at least a portion of the plurality of periodic datasets to one or more processing and/or evaluation techniques. For example, in some embodiments, the processing may include the application of one or more data reduction techniques to smooth the periodic set of data. The data reduction techniques may include data pre-processing, data cleansing, numerosity reduction, or a combination thereof. The data pre-processing technique may remove out-of-range values and/or flag missing values within the dataset. The data cleansing process(es) may include the use of statistical methods, data duplicate-elimination methods, and the parsing of data for the removal of corrupt or inaccurate data points. In some embodiments, the post-processing periodic dataset may be saved to the system performance file.

In some embodiments the post-processing periodic dataset may be averaged to produce an average value representative of each set of periodic data. The average value may be a single value that represents a plurality of values across a given duration. The average value may be determined by applying one or more mathematical techniques such as an arithmetic mean, a median, a geometric median, a mode, a geometric mean, a harmonic mean, a generalized mean, a moving average, or combinations thereof. The unit controller 140 may save the average value to the system performance file. In some embodiments, the average value may be determined as each of the plurality of periodic datasets is generated, for example, in real-time or, alternatively, at a later time.

In some embodiments, the assessing, post-processing, and averaging of the plurality of the periodic datasets may include one or more "Edge Computing" locations. For example, the unit controller 140 may transmit the system performance file to a network location via a mobile communication network for processing of the periodic datasets. The unit controller 140 may retrieve or receive the system performance file post-processing.

In some embodiments, assessing the plurality of periodic datasets may further comprise determining one or more functions, e.g., mathematical functions, representative of each of the plurality of periodic datasets. For example, in an embodiment, a function may be determined as discussed with respect to FIG. 4. FIG. 4 illustrates an example of a system performance graph 300. In an embodiment, the system performance graph 300 illustrates flowrate with respect to valve position, for example, having a y-axis 302 with flowrate units and an x-axis 304 with valve position units. For example, the y-axis 302 may display the flowrate data with units of volumetric flowrate such as gallons per minute (GPM) or barrels per hour (BPH). The x-axis 304 may display the valve position data as a percentage of the opening value of the valve position, such as 50% open or 100% open. The graph of the system performance graph 300 may comprise a curve for each pump speed, such as 100%, 75%, and 50% of pump speed. In the embodiment of FIG. 4, a first curve 310, e.g., system performance curve, may be for a pump speed of the supply pump 124 of 100%. A second curve 312, e.g., system performance curve, may be for a pump speed of the supply pump 124 of 75%. A third curve 314, e.g., system performance curve, may be for a flow capacity of the supply pump 124 of 50%. Although three system performance curves are illustrated, it is understood that there may be a system performance curve for each pump speed. A first line 322 may represent a valve position of 100% open. A second line 326 may represent a valve position of 50% open. The minimum data point on the first curve 310 may be at the origin of the system performance graph 300 where the valve position is 0% open or also referred to as closed. The maximum data point on the first curve 310 may be at data point 324 where the valve position is 100% open and the pump is operating with pump speed of 100%. The average data points may be displayed on the system performance graph 300. For example, average data point 332 on the first curve 310 may coincide with the second line 326 from the x-axis 304 for the valve position of 50% open and the pump operating with a pump speed of 100%.

A system mathematical function may be determined that best fits each the plurality of average values for each pump speed. An example of a mathematical function can be; $y=Ax^2+Bx+C$. The mathematical function may be determined using mathematical techniques of interpolation or data smoothing to obtain the best fit of the dataset. The mathematical equation can be a function of the y-axis 302 where value of the y-axis 302 is a flowrate value dependent on the value of the x-axis 304, i.e., the value of the valve position. The value for C in the example mathematical function may be a zero value when the minimum value of the equation coincides with the origin, e.g., point 320. Although the mathematical function in the example is a polynomial equation, it is understood that the mathematical function may be polynomial, logarithmic, exponential, or combination thereof. At least one system mathematical function may be recorded and saved to the system performance file. In some embodiments, the unit controller 140 may cause at least one of the curves and/or a system mathematical function to be displayed on the interactive display 144. In some embodiments, the determination of one or more system mathematical functions may be processed by one or more "Edge Computing" locations. For example, the unit controller 140 may transmit the system performance file to a network location via a mobile communication network for processing of the system mathematical functions. The unit controller 140 may retrieve or receive the system performance file post-processing.

In an embodiment, assessing the plurality of periodic datasets may further comprise interpolating a value for a valve position on the x-axis 304. In an example, the first curve 310 may have a known data point 332. The data point 332 may be a flowrate value 334 at a valve position value, e.g., 50% open, as shown by the second line 326 and may lie along or proximate to the first curve 310 for the pump operating at 100% pump speed, e.g., 100% capacity. The unit controller 140 may determine an equivalent value 330 on the second curve 312 for the pump operating at 75% pump speed. A third line 336 representing the valve position value for the equivalent value 330 on the second curve 312 for the flowrate value 334 may be interpolated, for example, by a suitable method of mathematical interpolation such as linear interpolation, polynomial interpolation, spline interpolation, or a combination thereof. The system mathematical function may be solved for the second curve 312 for the flowrate value 334 by iteratively substituting a valve position value until the calculated flowrate value is within a threshold value of the flowrate value 334. The unit controller 140 may write the calculated point, also called the equivalent value 330, to the system performance file.

In an embodiment, the health of the mixing system 120 can be determined based on the results of the diagnostic test. In some embodiments, the results of the diagnostic test may comprise one or more averaged values, a plurality of averaged values, a system performance curve, a system mathematical function, or combination thereof. In an example, the results of the diagnostic test can be compared to the minimum operational capacity for the mixing system 120. Additionally or alternatively, the results of the diagnostic test can be compared to maintained operational capacity, for example, an expected capacity based upon prior use and maintenance of the mixing system. Additionally or alternatively, the results of the diagnostic test can be compared a historical database, for example, a capacity based upon historical data from multiple mixing systems and components.

In various embodiments, the results of the diagnostic test may be compared to an operational indicator set, which may comprise a configuration check, the minimum operational capacity, a nominal operational capacity, a series of failure modes, or combinations thereof.

In an embodiment, the nominal operational capacity can comprise one or more values indicative of the normal operational capacity of a well-maintained or recently-serviced portion of the pump unit 100, e.g., the mixing system 120. The values of the nominal operational capacity, e.g., system performance curve, can be indicative of the nominal operational capacity of the mixing system 120 comprising the supply pump 124 and the flow control valve 152 of the liquid delivery system 134.

In an embodiment, the failure modes may comprise one or more values indicative of one or more failure modes, e.g., bearing failure, of the mixing system 120. The values of the failure modes can be indicative of one or more failures of the mixing system 120 or a component thereof. For example, failure of the supply pump 124 to achieve a pressure value during the diagnostic test may be indicative of an imminent seal failure.

In an embodiment, the configuration check of the operational indicator set can comprise one or more values indicative of a proper configuration of the mixing system 120.

The results from the comparison between the results of the diagnostic test and the operational indicator set may yield a status for the mixing system 120. For example, where the system performance file meets or exceeds the values of the configuration check, the mixing system 120 may have a "passing" or "acceptable" status; where it does not, the mixing system may have a "failing" or unacceptable status. Additionally or alternatively, where the system performance file meets or exceeds the values of the minimum operational capacity[[,]] check, the mixing system 120 may have a "passing" or "acceptable" status; where it does not, the mixing system may have a "failing" or unacceptable status. Additionally or alternatively, where the system performance file meets or exceeds the values of the nominal operational capacity, check, the mixing system 120 may have a "passing" or "acceptable" status; where it does not, the mixing system may have a "failing" or unacceptable status. Additionally or alternatively, where the system performance file meets or exceeds the series of failure modes, the mixing system 120 may have a "passing" or "acceptable" status; where it does not, the mixing system may have a "failing" or unacceptable status.

In some embodiments, the method for determining health of the mixing system 120 may further comprise the step of creating one or more outputs responsive to the status of the mixing system 120.

In various embodiments, the output may comprise indicia of the health of the mixing system, for example, a visual cue (e.g., an indicator light), textual information or messages indicating the mixing system 120 status, an audible cue such as an alarm or a buzzer, or combinations thereof.

For example, referring again to FIG. 2, the unit controller 140 may display an alert on the interactive display 144. The alert may be displayed on the interactive display 144 as a curve, a table, or a simple pass or fail, e.g., pass/fail status. For example, a pass/fail status may be a color indicator including a green color for a passing status while a failing status can be a red color. A pass/fail status can include a multiple color indicator to indicate a range such as green, yellow, and red. The yellow can be a warning of a bottom of the range value. A pass/fail message, e.g., text message, may be included when the result is a fail.

In some embodiments, one or more of the steps of assessing the plurality of periodic datasets, determining the health of the mixing system, and creating one or more outputs responsive to the status of the mixing system may be carried out via the operation of the unit controller 140.

Figure 5:
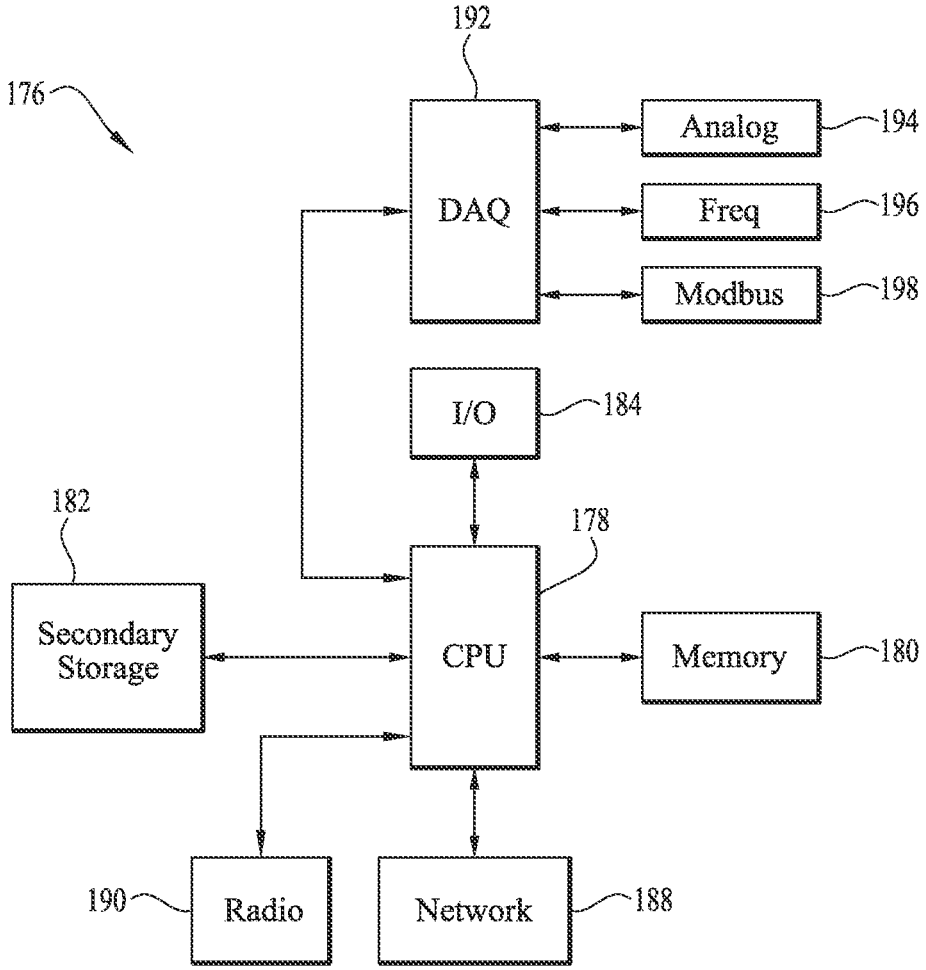
FIG. 5 is a block diagram of a unit controller according to an embodiment of the disclosure.

A unit controller, for example, the unit controller 48 of FIG. 1 or the unit controller 140 of FIG. 2, may be a computer system suitable for communication and control of various components of the pumping unit. An embodiment of a unit controller, for example, the unit controller 48 of FIG. 1 or the unit controller 140 of FIG. 2, is illustrated in FIG. 5 as a computer system 176. In the embodiment of FIG. 5, the computer system 176 includes one or more processors 178 (which may be referred to as a central processor unit or CPU) that is in communication with memory 180, secondary storage 182, input output devices 184, DAQ card 192, and network devices 188. The computer system 176 may continuously monitor the state of the input devices and change the state of the output devices based on a plurality of programmed instructions. The programming instructions may comprise one or more applications retrieved from memory 180 for executing by the processor 178 in non-transitory memory within memory 180. The input output devices may comprise a HMI, e.g., interactive display 144 in FIG. 2, with a display screen and/or the ability to receive conventional inputs from the service personnel such as push button, touch screen, keyboard, mouse, or any other such device or element that a service personnel may utilize to input a command to the computer system 176. The secondary storage 182 may comprise a solid state memory, a hard drive, or any other type of memory suitable for data storage. The secondary storage 182 may comprise removable memory storage devices such as solid state memory or removable memory media such as magnetic media and optical media, i.e., CD disks. The computer system 176 can communicate with various networks with the network devices 188 comprising wired networks, e.g., Ethernet or fiber optic communication, and short range wireless networks such as Wi-Fi (i.e., IEEE 802.11), Bluetooth, or other low power wireless signals such as ZigBee, Z-Wave, 6LoWPan, Thread, and WiFi-ah. The computer system 176 may include a long range radio transceiver 190 for communicating with mobile network providers as will be disclosed further herein.

The computer system 176 may comprise a DAQ card 192 for communication with one or more sensors. The DAQ card 192 may be a standalone system with a microprocessor, memory, and one or more applications executing in memory. The DAQ card 192, as illustrated, may be a card or a device within the computer system 176. In an embodiment, the DAQ card 192 may be combined with the input output device 184. The DAQ card 192 may receive one or more analog inputs 194, one or more frequency inputs 196, and one or more Modbus inputs 198. For example, the analog input 194 may include a tub level sensor. For example, the frequency input 196 may include a flow meter, i.e., flowrate sensor 156 from FIG. 3. For example, the Modbus input 198 may include a pressure transducer, i.e., pressure transducer 164 from FIG. 3. The DAQ card 192 may convert the signals received via the analog input 194, the frequency input 196, and the Modbus input 198 into the corresponding sensor data. For example, the DAQ card 192 may convert a frequency input 196 from the flowrate sensor 156 shown in FIG. 3 into flow rate data measured in gallons per minute (GPM).

Additionally or alternatively, in an embodiment, one or more of the steps of assessing the plurality of periodic datasets, determining the health of the mixing system, and/or creating one or more outputs responsive to the status of the mixing system may be carried out via the operation of a computer located at a remote location, for example, a remote service center. Additionally or alternatively, in an embodiment, one or more of the steps of assessing the plurality of periodic datasets, determining the health of the mixing system, and/or creating one or more outputs responsive to the status of the mixing system may be carried out cooperatively via the operation of the unit controller 140 and a computer located at the remote location, for example, the remote service center. For example, in an embodiment, the unit controller 140 may transmit data from the diagnostic test, e.g., the system performance file, to a remote service center as will be described further therein, for example, via a data communication center.

Figure 6:
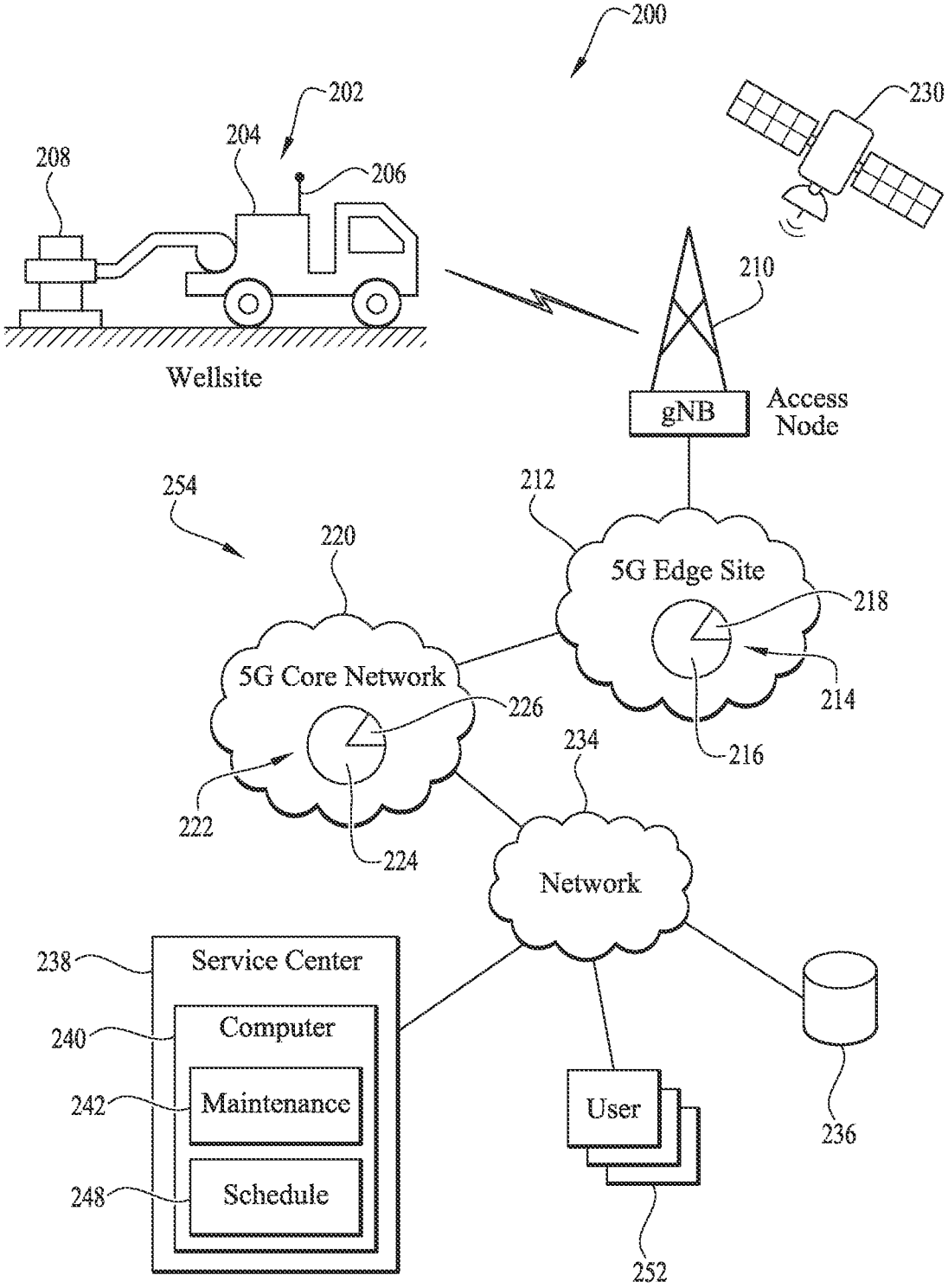
FIG. 6 is an illustration of a communication system according to an embodiment of the disclosure.
Figure 7:
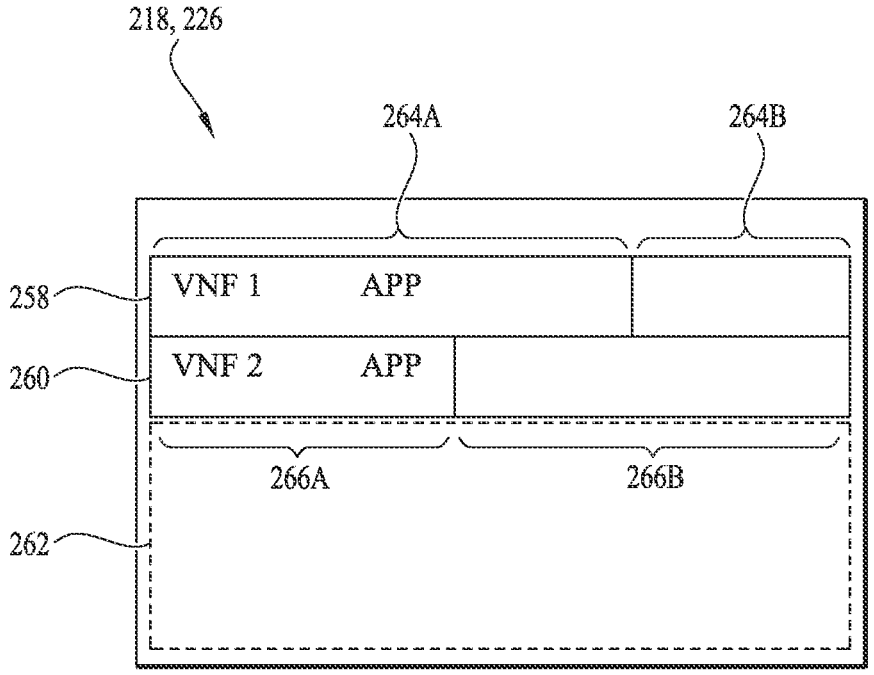
FIG. 7 is a block diagram of an application within a virtual network function on a network slice according to an embodiment of the disclosure.

For example, data can be transmitted, via a data communication system, and received by various wired or wireless means between the pump unit 100 at a wellsite and a remote service center for further processing. Referring to FIG. 6, a data communication system 200 is described. The data communication system 200 comprises a pump unit 204 disposed at a wellsite 202, an access node 210 (e.g., cellular site), a mobile carrier network 254, a network 234, a storage computer 236, a service center 238, and a plurality of user devices 252. The pump unit 204 can include a communication device 206 (e.g., transceiver 190 of FIG. 5) that can transmit and/or receive via any suitable communication means (wired or wireless), for example, to wirelessly connect to an access node 210 to transmit data (e.g., the system performance file) to a storage computer 236. The storage computer 236 may also be referred to as a data server, data storage server, or remote server. The storage computer 236 may include a database, which may be used to store system performance files and/or diagnostic test results. Wireless communication can include various types of radio communication, including cellular, satellite 230, or any other form of long range radio communication. The communication device 206 can transmit data via wired connection for a portion or the entire way to the storage computer 236. The communication device 206 may communicate over a combination of wireless and wired communication. For example, communication device 206 may wirelessly connect to access node 210 that is communicatively connected to a network 234 via a mobile carrier network 254.

In an embodiment, the communication device 206 on the pump unit 204 is communicatively connected to the mobile carrier network 254 that may comprise the access node 210, a 5G edge site 212, a 5G core network 220, and the network 234. The communication device 206 may be the transceiver 190 connected to the computer system 176 of FIG. 5. The computer system 176 may be the unit controller 140 of FIG. 2 or unit controller 48 of FIG. 1, thus the communication device 206 may be communicatively connected to the unit controller 140 and/or 48.

The access node 210 may also be referred to as a cellular site, cell tower, cell site, or, with 5G technology, a gigabit Node B. The access node 210 provides wireless communication links to the communication device 206, e.g., unit controller 140 and/or unit controller 48, according to a 5G, a long term evolution (LTE), a code division multiple access (CDMA), or a global system for mobile communications (GSM) wireless telecommunication protocol.

The communication device 206 may establish a wireless link with the mobile carrier network 254 (e.g., 5G core network 220) with a long-range radio transceiver, e.g., 190 of FIG. 5, to receive data, communications, and, in some cases, voice and/or video communications. The communication device 206 may also include a display and an input device (e.g., interactive display 144 or HMI), a camera (e.g., video, photograph, etc.), a speaker for audio, or a microphone for audio input by a user. The long-range radio transceiver, e.g., radio transceiver 190, of the communication device 206 may be able to establish wireless communication with the access node 210 based on a 5G, LTE, CDMA, or GSM telecommunications protocol. The communication device 206 may be able to support two or more different wireless telecommunication protocols and, accordingly, may be referred to in some contexts as a multi-protocol device. The communication device 206, e.g., device 206A, may communicate with another communication device, e.g., device 206B, on a second pump truck, e.g., pump unit 204B, via the wireless link provided by the access node 210 and via wired links provided by the mobile carrier network 254, e.g., 5G edge site 212 or the 5G core network 220. Although the pump unit 204 and the communication device 206 are illustrated as a single device, the pump unit 204 may be part of a system of pump units, e.g., a frac fleet. For example, a pump unit 204A may communicate with pump units 204B, 204C, 204D, 204E, and 204F at the same wellsite, e.g., wellsite 202 of FIG. 6, or at multiple wellsites. In an embodiment, the pump units 204A-E may be a different types of pump units at the same wellsite or at multiple wellsites. For example, the pump unit 204A may be a frac pump, pump unit 204B may be a blender, pump unit 204C may be water supply unit, pump unit 204D may be a cementing unit, and pump unit 204E may be a mud pump. The pump unit 204A-F may be communicatively coupled together at the same wellsite by one or more communication methods. The pump units 204A-F may be communicatively coupled with a combination of wired and wireless communication methods. For example, a first group of pump units 204A-C may be communicatively coupled with wired communication, e.g., Ethernet. A second group of pump units 204D-E may be communicatively couple to the first group of pump units 204A-C with low powered wireless communication, e.g., WIFI. A third group of pump units 204F may be communicatively coupled to one or more of the first group or second group of pump units by a long range radio communication method, e.g., mobile communication network.

The 5G edge site 212 can be communicatively coupled to the access node 210. The 5G edge site 212 may also be referred to as a regional data center (RDC) and can include a virtual network in the form of a cloud computing platform. The cloud computing platform can create a virtual network environment from standard hardware such as servers, switches, and storage. The total volume of computing availability 214 of the 5G edge site 212 is illustrated by a pie chart with a portion illustrated as a network slice 218 and the remaining computing availability 216. The network slice 218 represents the computing volume available for storage or for processing of data. The network slice 218 may be referred to as a network location. The cloud computing environment is described in more detail, further hereinafter. Although the 5G edge site 212 is shown communicatively coupled to the access node 210, it is understood that the 5G edge site 212 may be communicatively coupled to a plurality of access nodes (e.g., access node 210). The 5G edge site 212 may receive all or a portion of the voice and data communications from one or more access nodes (e.g., access node 210). The 5G edge site 212 may process all or a portion of the voice and data communications or may pass all or a portion to the 5G core network 220 as will be described further hereinafter. Although the virtual network is described as created from a cloud computing network, it is understood that the virtual network can be formed from a network function virtualization (NFV). The NFV can create a virtual network environment from standard hardware such as servers, switches, and storage. The NFV is more fully described by ETSI GS NFV 002 v1.2.1 (2014-12).

The 5G core network 220 can be communicatively coupled to the 5G edge site 212 and provide a mobile communication network via the 5G edge site 212 and one or more access node 210. Although the access node 210 is illustrated as communicatively connected to the 5G edge site 212, it is understood that one or more access nodes, e.g., access node 210, may be communicatively connected to the 5G core network 220. The 5G core network 220 can include a virtual network in the form of a cloud computing platform. The cloud computing platform can create a virtual network environment from standard hardware such as servers, switches, and storage. The total volume of computing availability 222 of the 5G core network 220 is illustrated by a pie chart with a portion illustrated as a network slice 226 and the remaining computing availability 224. The network slice 226 may be referred to as a network location. The network slice 226 represents the computing volume available for storage or processing of data. The cloud computing environment is described in more detail further hereinafter. Although the 5G core network 220 is shown communicatively coupled to the 5G edge site 212, it is understood that the 5G core network 220 may be communicatively coupled to a plurality of access nodes (e.g., access node 210) in addition to one or more 5G edge sites (e.g., edge site 212). The 5G core network 220 may be communicatively coupled to one or more Mini Data Centers (MDC). MDC may be generally described as a smaller version or self-contained 5G edge site comprising an access node, e.g., access node 210, with a cloud computing platform, e.g., a virtual network environment, created from standard computer system hardware, e.g., processors, switches, and storage. The 5G core network 220 may receive all or a portion of the voice and data communications via 5G edge site 212, one or more MDC nodes, and one or more access nodes (e.g., access node 210). The 5G core network 220 may process all or a portion of the voice and data communications as will be described further hereinafter. Although the virtual network is described as created from a cloud computing network, it is understood that the virtual network can be formed from a network function virtualization (NFV). The NFV can create a virtual network environment from standard hardware such as servers, switches, and storage.

A storage computer 236 can be communicatively coupled to the 5G network, e.g., mobile carrier network 254, via the network 234. The storage computer 236 can be a computer, a server, or any other type of storage device. The storage computer 236 may be referred to as a network location. The network 234 can be one or more public networks, one or more private networks, or a combination thereof. A portion of the Internet can be included in the network 234.

The service center 238 may serve as a base of operations for a plurality of pump units, for example, providing maintenance for the pump unit 204. Maintenance operations can include repair, replacement, modification, upgrades, or a combination thereof of the equipment on the pump unit 204 including, referring back to FIG. 2, the unit controller 140, the DAQ card 142, the interactive display 144, i.e., HMI, the power supply 108, the supply tank 102, the mixing system 120, the additive system 122, the main pump 106, the plurality of pumps, e.g., supply pump 124, the plurality of valves, e.g., flow control valve 152, the plurality of sensors, e.g., flowrate sensor 156, or combinations thereof.

The service center 238 may have a central computer 240 executing one or more applications, for example, a maintenance application 242. The maintenance application 242 may assign a pump unit, e.g., pump unit 204, for maintenance to one or more components on the pump unit, e.g., main pump 106, on the maintenance schedule 248. In an embodiment, the maintenance application 242 may receive or retrieve a system performance file associated with the pump unit 204 from a historical database on the storage computer 236. The central computer 240 access the system performance file and determine if the results of the diagnostic test are below a threshold value or if system performance file may include an alert indicating that the diagnostic test generated a fault value, error value, or at least one data point below an operational threshold. In an embodiment, the central computer 240, for example, the maintenance application 242, may send one or more alerts to one or more user devices 252 communicatively connected to the maintenance application 242 via the network 234. Additionally or alternatively, the central computer 240 may schedule service, for example, at the service center 238, to diagnose or remedy an issue with a pump unit 204 based upon the results of the diagnostic test, for example, to replace one or more seals within the supply pump 124.

Although the maintenance application 242 is described as executing on a central computer 240, it is understood that the central computer 240 can be a computer system or any form of a computer system such as a server, a workstation, a desktop computer, a laptop computer, a tablet computer, a smartphone, a cloud computing environment, or any other type of computing device. The central computer 240 (e.g., computer system) can include one or more processors, memory, input devices, and output devices, as described in more detail further hereinafter. Although the service center 238 is described as having the maintenance application 242 executing on a central computer 240, it is understood that the service center 238 can have 2, 3, 4, or any number of computers 240 (e.g., computer systems) with 2, 3, 4, or any number of maintenance applications 242 executing on the central computers 240.

In an aspect, the mobile carrier network 254 includes a 5G core network 220 and a 5G edge site 212 with virtual servers in a cloud computing environment. One or more servers of the type disclosed herein, for example, storage computer 236 and central computer 240, can be provided by a virtual network function (VNF) executing within the 5G core network. The pump unit 204 on the wellsite 202 can be communicatively coupled to the 5G edge site 212, which includes the 5G core network 220 via the access node 210 (e.g., gigabit Node B) and thus can be communicatively coupled to one or more VNFs with virtual servers as will be more fully described hereinafter. Turning now to FIG. [[6]]7, a representative example of a network slice 218 and/or 226 is described. A computing service executing on network slice 218 and/or 226 can comprise a first virtual network function (VNF) 258, a second VNF 260, and an unallocated portion 262. The computing service can comprise a first application 264A executing on a first VNF 258 and a second application 266A executing on a second VNF 260. The first application 264A and second application 266A can be computing service applications generally referred to as remote applications. The total computing volume can comprise a first VNF 258, a second VNF 260, and an unallocated portion 262. The unallocated portion 262 can represent computing volume reserved for future use. The first VNF 258 can include a first application 264A and additionally allocated computing volume 264B. The second VNF 260 can include a second application 266A and additionally allocated computing volume 266B. Although two VNFs are illustrated, the network slice 218 and/or 226 can have a single VNF, two VNFs, or any number of VNFs. Although the first VNF 258 and second VNF 260 are illustrated with equal computing volumes, it is understood that the computing volumes can be non-equal and can vary depending on the computing volume needs of each application. The first application 264A executing in the first VNF 258 can be configured to communicate with or share data with the second application 266A executing in the second VNF 260. The first application 264A and second application 266A can be independent and not share data or communicate with each other. Although the network slice 218 and/or 226 is illustrated with two VNFs and an unallocated portion 262, the network slice 218 and/or 226 may be configured without an unallocated portion 262. Although only one application, a first application 264A, is described executing within the first VNF 258, two or more applications can be executing within the first VNF 258 and second VNF 260. In an embodiment, the network slice 218 and/or 226 may be the network slice 218 on the 5G edge site 212. In an embodiment, the network slice 226 may be the network slice 226 on the 5G core network 220. In an embodiment, the first application 264A and/or the second application 266A executing on the first VNF 258 and/or second VNF 260 may be the maintenance application 242, the maintenance schedule 248, the storage computer 236, the historical database of system performance files, or combination thereof.

Figure 8A:
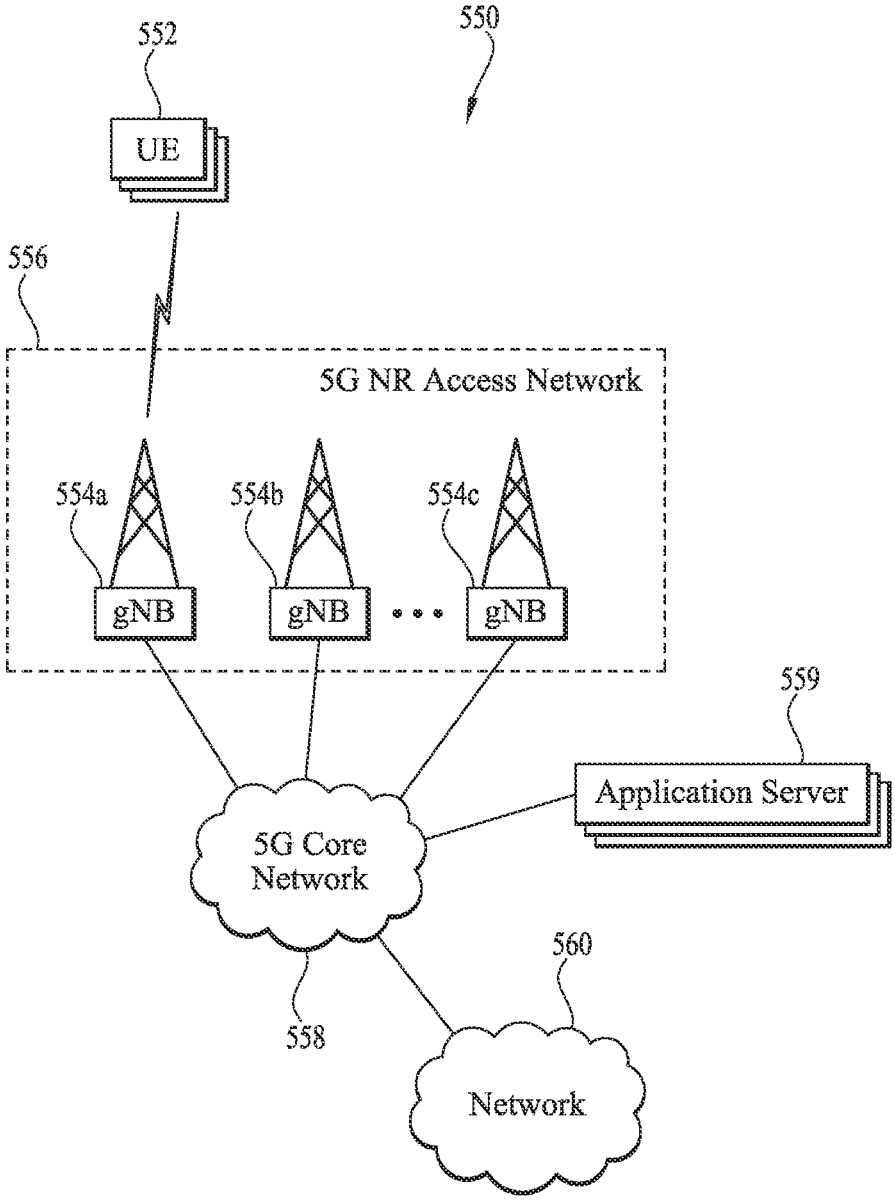
FIG. 8A is a block diagram of an exemplary communication system according to an embodiment of the disclosure.

Turning now to FIG. 8A, an embodiment of a communication system 550 is described suitable for implementing one or more embodiments disclosed herein, for example implementing communications or messaging as disclosed herein including without limitation, wireless communication between the communication device 206 and the mobile carrier network 254 on FIG. 6; communications with the computing components and network associated with FIG. 5 (e.g., long range radio transceiver 190); and the like. Typically, the communication system 550 includes a number of access nodes, a first access node 554*a*, a second access node 554*b*, and a third access node 554*c* (collectively, access nodes 554) that are configured to provide coverage in which a plurality of user equipment (UEs) 552 such as cell phones, tablet computers, machine-type-communication devices, unit controllers, tracking devices, embedded wireless modules, and/or other wirelessly equipped communication devices (whether or not user operated), can operate. The access nodes 554 may be said to establish an access network 556. The access network 556 may be referred to as a radio access network (RAN) in some contexts. In a 5G technology generation an access node 554 may be referred to as a gigabit Node B (gNB). In 4G technology (e.g., long term evolution (LTE) technology) an access node 554 may be referred to as an enhanced Node B (eNB). In 3G technology (.e.g., code division multiple access (CDMA) and global system for mobile communication (GSM)) an access node 554 may be referred to as a base transceiver station (BTS) combined with a basic station controller (BSC). In some contexts, the access node 554 may be referred to as a cell site or a cell tower. In some implementations, a picocell may provide some of the functionality of an access node 554, albeit with a constrained coverage area. Each of these different embodiments of an access node 554 may be considered to provide roughly similar functions in the different technology generations.

It is understood that the access network 556 may include any number of access nodes 554. Further, each access node 554 could be coupled with a core network 558 that provides connectivity with various application servers 559 and/or a network 560. In an embodiment, at least some of the application servers 559 may be located close to the network edge (e.g., geographically close to the UE 552 and the end user) to deliver so-called "edge computing." The network 560 may be one or more private networks, one or more public networks, or a combination thereof. The network 560 may comprise the public switched telephone network (PSTN). The network 560 may comprise the Internet. With this arrangement, a UE 552 within coverage of the access network 556 could engage in air-interface communication with an access node 554 and could thereby communicate via the access node 554 with various application servers and other entities.

The communication system 550 could operate in accordance with a particular radio access technology (RAT), with communications from an access node 554 to UEs 552 defining a downlink or forward link, and communications from the UEs 552 to the access node 554 defining an uplink or reverse link. Over the years, the industry has developed various generations of RATs, in a continuous effort to increase available data rate and quality of service for end users. These generations have ranged from "1G," which used simple analog frequency modulation to facilitate basic voice-call service, to "4G"— such as Long Term Evolution (LTE), which now facilitates mobile broadband service using technologies such as orthogonal frequency division multiplexing (OFDM) and multiple input multiple output (MIMO).

Figure 8B:
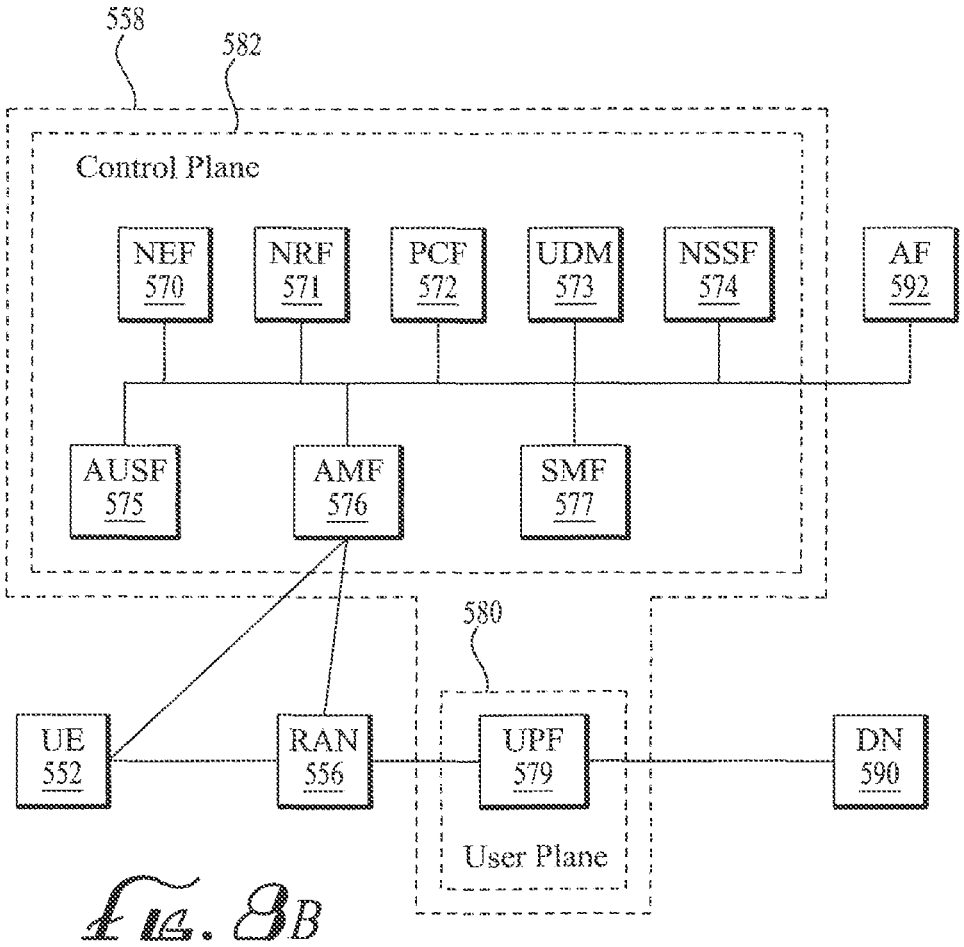
FIG. 8B is a block diagram of a 5G core network according to an embodiment of the disclosure.

Turning now to FIG. 8B, further details of the core network 558 are described. In an embodiment, the core network 558 is a 5G core network. 5G core network technology is based on a service based architecture paradigm. Rather than constructing the 5G core network as a series of special purpose communication nodes (e.g., an HSS node, a MME node, etc.) running on dedicated server computers, the 5G core network is provided as a set of services or network functions. These services or network functions can be executed on virtual servers in a cloud computing environment which supports dynamic scaling and avoidance of long-term capital expenditures (fees for use may substitute for capital expenditures). These network functions can include, for example, a user plane function (UPF) 579, an authentication server function (AUSF) 575, an access and mobility management function (AMF) 576, a session management function (SMF) 577, a network exposure function (NEF) 570, a network repository function (NRF) 571, a policy control function (PCF) 572, a unified data management (UDM) 573, a network slice selection function (NSSF) 574, and other network functions. The network functions may be referred to as virtual network functions (VNFs) in some contexts.

Network functions may be formed by a combination of small pieces of software called microservices. Some microservices can be re-used in composing different network functions, thereby leveraging the utility of such microservices. Network functions may offer services to other network functions by extending application programming interfaces (APIs) to those other network functions that call their services via the APIs. The 5G core network 558 may be segregated into a user plane 580 and a control plane 582, thereby promoting independent scalability, evolution, and flexible deployment.

The NEF 570 securely exposes the services and capabilities provided by network functions. The NRF 571 supports service registration by network functions and discovery of network functions by other network functions. The PCF 572 supports policy control decisions and flow based charging control. The UDM 573 manages network user data and can be paired with a user data repository (UDR) that stores user data such as customer profile information, customer authentication number, and encryption keys for the information. An application function 592, which may be located outside of the core network 558, exposes the application layer for interacting with the core network 558. In an embodiment, the application function 592 may be execute on an application server 559 located geographically proximate to the UE 552 in an "edge computing" deployment mode. The core network 558 can provide a network slice to a subscriber, for example an enterprise customer, that is composed of a plurality of 5G network functions that are configured to provide customized communication service for that subscriber, for example to provide communication service in accordance with communication policies defined by the customer. The NSSF 574 can help the AMF 576 to select the network slice instance (NSI) for use with the UE 552.

The systems and methods disclosed herein may be advantageously employed in the context of wellbore servicing operations, particularly, in relation to the usage of wellbore servicing equipment as disclosed herein.

In an embodiment, the diagnostic test disclosed herein may identify equipment failures or decreases in operability that might not otherwise be identifiable. For example, a reduction in pump output of a pump (e.g., the supply pump 124) may be gradual and difficult to quantify or identify. The diagnostic test disclosed herein, in which a partly closed flow control valve 152 can increase the head pressure while decreasing the flowrate of the supply pump 124 can impart additional stress and can reveal a decrease in the pump output and thus a decrease in the operational capacity of the liquid delivery system 134.

Additionally or alternatively, the diagnostic test disclosed herein may be automatically performed prior to the initiation of a wellbore servicing operation, at the completion of a wellbore servicing operation, or both. The unit controller 140 may automatically initiate the diagnostic test upon startup or shutdown of the pumping unit 100, or may prompt the service personnel to initiate the diagnostic test. The unit controller 140 may prevent operation of the pumping unit 100 until the diagnostic test is completed.

Additionally or alternatively, the diagnostic test disclosed herein may determine if the pumping unit 100 can complete a wellbore servicing operation without interruption. The diagnostic test can determine if one or more components of the mixing system 120 can operate within operational limits of pumping unit 100. Additionally, the diagnostic test can determine if one or more components of the mixing system 120 has decreased in operational capacity below a threshold value.

ADDITIONAL DISCLOSURE

The following are non-limiting, specific embodiments in accordance with the present disclosure:

A first embodiment, which is a computer-implemented method of determining a health status of a mixing system associated with a wellbore pump unit, the method comprising establishing, by a unit controller, a flow loop providing a route of fluid communication via a supply pump, a flow control valve, and a flow rate sensor, wherein the unit controller comprises a processor, a non-transitory memory, and an input output device, performing, by the unit controller, a diagnostic test, wherein the diagnostic test comprises positioning the flow control valve in a first position, operating the supply pump to communicate a fluid via the flow loop at a first speed, measuring, by the flow sensor, a first periodic dataset while the fluid is communicated via the flow loop with the flow control valve in the first position, and recording the first periodic dataset in memory, wherein the first periodic dataset is associated with the first speed of the supply pump and the first position of the flow control value, comparing a result of the diagnostic test to an operational indicator set, determining the health status of the mixing system based upon the comparison of the result of the diagnostic test and the operational indicator set, and outputting, by the unit controller, indicia of the health status of the mixing system via the input output device, wherein the indicia of the health status of the mixing system comprises a visual cue, and audible cue, or both.

A second embodiment, which is the method of the first embodiment, wherein the diagnostic test further comprises positioning the flow control valve in a second position, operating the supply pump to communicate the fluid via the flow loop at the first speed, measuring, by the flow sensor, a second periodic dataset while the fluid is communicated via the flow loop with the flow control valve in the first position, and recording the second periodic dataset in memory, wherein the second periodic dataset is associated with the first speed of the supply pump and the second position of the flow control value.

A third embodiment, which is the method of the second embodiment, wherein the diagnostic test further comprises positioning the flow control valve in the first position, operating the supply pump to communicate the fluid via the flow loop at the second speed, measuring, by the flowrate sensor, a third periodic dataset while the fluid is communicated via the flow loop with the flow control valve in the first position, and recording the third periodic dataset in memory, wherein the third periodic dataset is associated with the second speed of the supply pump and the first position of the flow control value.

A fourth embodiment, which is the method of any of the first through the third embodiments, wherein the diagnostic test further comprises operating the supply pump to communicate the fluid via the flow loop at each of at least two (2) speeds while the flow control valve is positioned in each of at least three (3) positions for each of the at least two (2) speeds.

A fifth embodiment, which is the method of any of the first through the fourth embodiments, wherein the operational indicator set comprises a configuration check, a minimum operational capacity, a nominal operational capacity, and a series of failure modes.

A sixth embodiment, which is the method of any of the first through the fifth embodiments, further comprising generating a first post-processing periodic dataset by applying one or more data reduction techniques to the first periodic dataset, wherein the data reduction techniques include data pre-processing, data cleansing, numerosity reduction, or a combination thereof, and generating a first averaged value for the first post-processing periodic dataset by averaging the first post-processing periodic dataset with a mathematical averaging technique, wherein the mathematical averaging techniques includes arithmetic mean, a median, a geometric median, a mode, a geometric mean, a harmonic mean, a generalized mean, a moving average, or combination thereof.

A seventh embodiment, which is the method of the sixth embodiment, wherein the result of the diagnostic test to which the operational indicator set is compared comprises the first post-processing periodic dataset, the first averaged value, or both.

An eighth embodiment, which is the method of the seventh embodiment, wherein one or more of comparing the result of the diagnostic test to the operational indicator set, determining the health status of the mixing system based upon the comparison of the result of the diagnostic test and the operational indicator set, generating the first post-processing periodic dataset, and generating the first averaged value for the first post-processing periodic dataset is performed via the unit controller.

A ninth embodiment, which is the method of any of the seventh and the eighth embodiments, wherein one or more of comparing the result of the diagnostic test to the operational indicator set, determining the health status of the mixing system based upon the comparison of the result of the diagnostic test and the operational indicator set, generating the first post-processing periodic dataset, and generating the first averaged value for the first post-processing periodic dataset is performed via a remote computer.

A tenth embodiment, which is the method of the ninth embodiment, further comprising transmitting the first periodic dataset, the first post-processing periodic dataset, the first averaged value for the first post-processing periodic dataset, or combinations thereof to the remote computer via a wireless communication protocol.

An eleventh embodiment, which is the method of the tenth embodiment, wherein the wireless communication protocol is at least one of a 5G, a long-term evolution (LTE), a code division multiple access (CDMA), or a global system for mobile communications (GSM) telecommunications protocol.

A twelfth embodiment, which is the method of any of the ninth through the eleventh embodiments, wherein the remote computer is disposed in a network location, wherein the network location is one of i) a VNF on a network slice within a 5G core network, ii) a VNF on a network slice within a 5G edge network, iii) a storage computer communicatively coupled to a network via a mobile communication network, or iv) a computer system communicatively coupled to the network via the mobile communication network.

A thirteenth embodiment, which is the method of the twelfth embodiment, wherein the network location comprises a database, a storage device, the remote computer, a virtual network function, or combination thereof.

A fourteenth embodiment, which is the method of any of the twelfth and the thirteenth embodiments, further comprising accessing, by the remote computer, a historical database on the network location, the historical database comprising data associated with a plurality of pump units.

A fifteenth embodiment, which is a wellbore servicing method comprising transporting a pump unit to a wellsite, the pump unit comprising unit controller configured to perform a diagnostic test, wherein the unit controller comprises a processor, a non-transitory memory, and an input output device, fluidically connecting the pump unit to a wellhead, establishing a flow loop providing a route of fluid communication via a supply pump, a flow control valve, and a flow rate sensor, performing the diagnostic test, wherein the diagnostic test comprises positioning the flow control valve in a first position, operating the supply pump to communicate a fluid via the flow loop at a first speed, measuring, by the flow sensor, a first periodic dataset while the fluid is communicated via the flow loop with the flow control valve in the first position, and recording the first periodic dataset in memory, wherein the first periodic dataset is associated with the first speed of the supply pump and the first position of the flow control value, comparing a result of the diagnostic test to an operational indicator set, determining the health status one or more components of the pump unit based upon the comparison of the result of the diagnostic test and the operational indicator set, and wherein the health status of the one or more components of the pump unit is a passing status, pumping a wellbore treatment into the wellbore.

A sixteenth embodiment, which is a system of wellbore pumping unit, comprising a wellbore pumping unit comprising a mixing system comprising a supply pump, a flow control valve, and a plurality of sensors, a unit controller comprising a processor, a non-transitory memory, an interactive display, a system performance file, and a diagnostic process executing in memory, configured to establish a flow loop providing a route of fluid communication via the supply pump, the flow control valve, and a flow rate sensor, wherein the unit controller comprises a processor, a non-transitory memory, and an input output device, perform a diagnostic test, wherein the diagnostic test comprises positioning the flow control valve in a first position, operating the supply pump to communicate a fluid via the flow loop at a first speed, measuring, by the flow sensor, a first periodic dataset while the fluid is communicated via the flow loop with the flow control valve in the first position, and recording the first periodic dataset in memory, wherein the first periodic dataset is associated with the first speed of the supply pump and the first position of the flow control value, compare a result of the diagnostic test to an operational indicator set, determine the health status of the mixing system based upon the comparison of the result of the diagnostic test and the operational indicator set, and output indicia of the health status of the mixing system via the input output device, wherein the health status of the mixing system a visual cue, and audible cue, or both.

A seventeenth embodiment, which is the system of the sixteenth embodiment, wherein the sensors comprise a plurality of pressure sensors, the flowrate sensor, valve position sensors, tub level sensors, or combinations thereof.

An eighteenth embodiment, which is the system of any of the sixteenth and the seventeenth embodiments, further comprising a remote computer in communication with the unit controller via a wireless communication protocol.

A nineteenth embodiment, which is the system of the eighteenth embodiment, wherein the wireless communication protocol is at least one of a 5G, a long-term evolution (LTE), a code division multiple access (CDMA), or a global system for mobile communications (GSM) telecommunications protocol.

A twentieth embodiment, which is the system of any of the sixteenth through the nineteenth embodiments, wherein the wellbore pumping unit is a mud pump, a cement pumping unit, a blender unit, a water supply unit, or a fracturing pump.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k* (Ru-RI), wherein k is a variable ranging from 1 percent to 100 percent with a 1 percent increment, i.e., k is 1 percent, 2 percent, 3 percent, 4 percent, 5 percent, 50 percent, 51 percent, 52 percent, 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A computer-implemented method of determining a health status of a mixing system associated with a wellbore pump unit, the computer-implemented method comprising:

establishing, by a unit controller, a flow loop providing a route of fluid communication via a supply pump, a flow control valve, and a flow rate sensor, wherein the unit controller comprises a processor, a non-transitory memory, and an input output device;

performing, by the unit controller, a diagnostic test, wherein the diagnostic test comprises:

positioning the flow control valve in a first position;

operating the supply pump to communicate a fluid via the flow loop at a first speed;

measuring, by the flow rate sensor, a first periodic dataset while the fluid is communicated via the flow loop with the flow control valve in the first position; and recording the first periodic dataset in the non-transitory memory, wherein the first periodic dataset is associated with the first speed of the supply pump and the first position of the flow control value;

comparing a result of the diagnostic test to an operational indicator set;

determining the health status of the mixing system based upon the comparison of the result of the diagnostic test and to the operational indicator set;

after determining the health status of the mixing system, determining an alteration of a flow rate to a desired flow rate based on the health status to ensure completion of ongoing wellbore servicing operations without interruption; and outputting, by the unit controller, indicia of the health status of the mixing system via the input output device, wherein the indicia of the health status of the mixing system comprises a visual cue, an audible cue, or both.

2. The computer-implemented method of claim 1, wherein the diagnostic test further comprises:

positioning the flow control valve in a second position;

operating the supply pump to communicate the fluid via the flow loop at the first speed;

measuring, by the flow rate sensor, a second periodic dataset while the fluid is communicated via the flow loop with the flow control valve in the second position; and recording the second periodic dataset in the non-transitory memory, wherein the second periodic dataset is associated with the first speed of the supply pump and the second position of the flow control value.

3. The computer-implemented method of claim 2, wherein the diagnostic test further comprises:

positioning the flow control valve in the first position;

operating the supply pump to communicate the fluid via the flow loop at a second speed;

measuring, by the flow rate sensor, a third periodic dataset while the fluid is communicated via the flow loop with the flow control valve in the first position; and recording the third periodic dataset in the non-transitory memory, wherein the third periodic dataset is associated with the second speed of the supply pump and the first position of the flow control value.

4. The computer-implemented method of claim 1, wherein the diagnostic test further comprises:

operating the supply pump to communicate the fluid via the flow loop at each of at least two (2) speeds while the flow control valve is positioned in each of at least three (3) positions for each of the at least two (2) speeds.

5. The computer-implemented method of claim 1, wherein the operational indicator set comprises a configuration check, a minimum operational capacity, a nominal operational capacity, and a series of failure modes.

6. The computer-implemented method of claim 1, further comprising:

generating a first post-processing periodic dataset by applying one or more data reduction techniques to the first periodic dataset, wherein the one or more data reduction techniques include data pre-processing, data cleansing, numerosity reduction, or a combination thereof; and generating a first averaged value for the first post-processing periodic dataset by averaging the first post-processing periodic dataset with a mathematical averaging technique, wherein the mathematical averaging technique includes an arithmetic mean, a median, a geometric median, a mode, a geometric mean, a harmonic mean, a generalized mean, a moving average, or a combination thereof.

7. The computer-implemented method of claim 6, wherein the result of the diagnostic test to which the operational indicator set is compared comprises the first post-processing periodic dataset, the first averaged value, or both.

8. The computer-implemented method of claim 7, wherein one or more of:

comparing the result of the diagnostic test to the operational indicator set, determining the health status of the mixing system based upon the comparison of the result of the diagnostic test to the operational indicator set, generating the first post-processing periodic dataset, and generating the first averaged value for the first post-processing periodic dataset is performed via the unit controller.

9. The computer-implemented method of claim 7, wherein one or more of:

comparing the result of the diagnostic test to the operational indicator set, determining the health status of the mixing system based upon the comparison of the result of the diagnostic test to the operational indicator set, generating the first post-processing periodic dataset, and generating the first averaged value for the first post-processing periodic dataset is performed via a remote computer.

10. The computer-implemented method of claim 9, further comprising:

transmitting the first periodic dataset, the first post-processing periodic dataset, the first averaged value for the first post-processing periodic dataset, or combinations thereof to the remote computer via a wireless communication protocol.

11. The computer-implemented method of claim 10, wherein the wireless communication protocol is at least one of a 5G, a long-term evolution (LTE), a code division multiple access (CDMA), or a global system for mobile communications (GSM) telecommunications protocol.

12. The computer-implemented method of claim 9, wherein the remote computer is disposed in a network location, wherein the network location is one of i) a virtual network function (VNF) on a network slice within a 5G core network, ii) a VNF on a network slice within a 5G edge network, iii) a storage computer communicatively coupled to a network via a mobile communication network, or iv) a computer system communicatively coupled to the network via the mobile communication network.

13. The computer-implemented method of claim 12, wherein the network location comprises a database, a storage device, the remote computer, the virtual network function on the network slice within the 5G core network, the VNF on the network slice within the edge network, or a combination thereof.

14. The computer-implemented method of claim 12, further comprising accessing, by the remote computer, a historical database on the network location, the historical database comprising data associated with a plurality of pump units.

15. A wellbore servicing method comprising:

transporting a pump unit to a wellsite, the pump unit comprising a unit controller configured to perform a diagnostic test, wherein the unit controller comprises a processor, a non-transitory memory, and an input output device;

fluidically connecting the pump unit to a wellhead;

establishing a flow loop providing a route of fluid communication via a supply pump, a flow control valve, and a flow rate sensor;

performing the diagnostic test, wherein the diagnostic test comprises:

positioning the flow control valve in a first position;

operating the supply pump to communicate a fluid via the flow loop at a first speed;

measuring, by the flow rate sensor, a first periodic dataset while the fluid is communicated via the flow loop with the flow control valve in the first position; and recording the first periodic dataset in the non-transitory memory, wherein the first periodic dataset is associated with the first speed of the supply pump and the first position of the flow control value;

comparing a result of the diagnostic test to an operational indicator set;

determining a health status of one or more components of the pump unit based upon the comparison of the result of the diagnostic test to the operational indicator set; the health status of the one or more components of the pump unit comprising a passing status for pumping a wellbore treatment into the wellbore, after determining the health status of the one or more components of the pump unit, determining an alteration of a flow rate based on the health status to ensure completion of ongoing wellbore servicing operations without interruption.

16. A system comprising:

a wellbore pumping unit comprising a mixing system comprising a supply pump, a flow control valve, and a plurality of sensors;

a unit controller comprising a processor, a non-transitory memory, an interactive display, a system performance file, and a diagnostic process executing in the non-transitory memory and configured to:

establish a flow loop providing a route of fluid communication via the supply pump, the flow control valve, and a flow rate sensor, wherein the unit controller further comprises an input output device;

perform a diagnostic test, wherein the diagnostic test comprises:

positioning the flow control valve in a first position;

operating the supply pump to communicate a fluid via the flow loop at a first speed;

measuring, by the flow rate sensor, a first periodic dataset while the fluid is communicated via the flow loop with the flow control valve in the first position; and recording the first periodic dataset in the non-transitory memory, wherein the first periodic dataset is associated with the first speed of the supply pump and the first position of the flow control value;

compare a result of the diagnostic test to an operational indicator set;

determine a health status of the mixing system based upon the comparison of the result of the diagnostic test to the operational indicator set;

after determining the health status of the mixing system, determine an alteration of a flow rate to a desired flow rate based on the health status to ensure completion of ongoing wellbore servicing operations without interruption; and output indicia of the health status of the mixing system via the input output device, wherein the health status of the mixing system comprises a visual cue, an audible cue, or both.

17. The system of claim 16, wherein:

the plurality of sensors comprise a plurality of pressure sensors, the flow rate sensor, valve position sensors, tub level sensors, or combinations thereof.

18. The system of claim 16, further comprising a remote computer in communication with the unit controller via a wireless communication protocol.

19. The system of claim 18, wherein the wireless communication protocol is at least one of a 5G, a long-term evolution (LTE), a code division multiple access (CDMA), or a global system for mobile communications (GSM) telecommunications protocol.

20. The system of claim 16, wherein the wellbore pumping unit is a mud pump, a cement pumping unit, a blender unit, a water supply unit, or a fracturing pump.

* * * * *